US008573281B2

(12) United States Patent
Drew et al.

(10) Patent No.: US 8,573,281 B2
(45) **Date of Patent: *Nov. 5, 2013**

(54) CORD TENSION CONTROL FOR TOP DOWN/BOTTOM UP COVERING FOR ARCHITECTURAL OPENINGS

(75) Inventors: Terrence M. Drew, Superior, CO (US); Jon C. Fearnow, Louisville, CO (US); Suzanne M. Fujita, Louisville, CO (US); Jeffrey L. Spray, Erie, CO (US)

(73) Assignee: Hunter Douglas Inc., Pearl River, NY (US)

( * ) Notice: Subject to any disclaimer, the term of this patent is extended or adjusted under 35 U.S.C. 154(b) by 128 days.

This patent is subject to a terminal disclaimer.

(21) Appl. No.: 13/105,492

(22) Filed: May 11, 2011

(65) Prior Publication Data

US 2011/0265963 A1 Nov. 3, 2011

Related U.S. Application Data

(63) Continuation-in-part of application No. 12/771,101, filed on Apr. 30, 2010.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 3/06*** | (2006.01) |
| ***E06B 9/305*** | (2006.01) |
| ***E06B 9/386*** | (2006.01) |
| ***E06B 9/388*** | (2006.01) |
| ***E06B 9/00*** | (2006.01) |

(52) U.S. Cl.
USPC ..... 160/84.05; 160/173 R; 160/178.1 R

(58) Field of Classification Search
USPC ..... 160/168.1 RR, 115, 170, 173 R, 84.03, 160/84.05; 242/157.1, 397.3
See application file for complete search history.

(56) References Cited

U.S. PATENT DOCUMENTS

| | | | | |
|---|---|---|---|---|
| 3,049,175 | A * | 8/1962 | Fukuoka | 160/177 R |
| 3,326,267 | A * | 6/1967 | Hauck | 160/107 |
| 6,957,681 | B2 | 10/2005 | Kim | |
| 2003/0226644 | A1 | 12/2003 | Koot et al. | |
| 2004/0182522 | A1 | 9/2004 | Strand et al. | |
| 2007/0144686 | A1 | 6/2007 | Drew | |
| 2008/0053626 | A1 | 3/2008 | Jarosinski et al. | |
| 2011/0265962 | A1 * | 11/2011 | Drew et al. | 160/340 |

OTHER PUBLICATIONS

U.S. Appl. No. 12/771,101, filed Apr. 30, 2010, Drew et al.
PCT International Search Report and PCT Written Opinion of corresponding PCT International Application No. PCT/US2011/034239 dated Jul. 22, 2011.

* cited by examiner

*Primary Examiner* — Katherine Mitchell
*Assistant Examiner* — Jeremy Ramsey
(74) *Attorney, Agent, or Firm* — Dorsey & Whitney LLP

(57) ABSTRACT

Cord tensioning systems are provided for top down/bottom up coverings to prevent entanglement of lift cords about associated wrap spools by correlating rotation of the wrap spools with translating threaded nuts mounted on threaded shafts rotating in unison with the wrap spools whereby abutment of nuts associated with lift spools prevent over movement of rails associated with the spools and thus entanglement of the lift cords associated therewith.

20 Claims, 31 Drawing Sheets

64
92A
120
116
114
112
68
140
148
132

120
68
92A
68
120
92B
148
148
132
64

116
112
140
148
64

120
120
112
112
68
132
68
64

CORD TENSION CONTROL FOR TOP DOWN/BOTTOM UP COVERING FOR ARCHITECTURAL OPENINGS

CROSS REFERENCE TO RELATED APPLICATION

This application is a continuation-in-part of U.S. application Ser. No. 12/771,101 filed on Apr. 30, 2010 and entitled "Cord Tension Control For Top Down/Bottom Up Covering For Architectural Openings", which is incorporated by reference into the present application it its entirety.

BACKGROUND OF THE INVENTION

1. Field of the Invention

The present invention relates generally to top down/bottom up coverings for architectural openings and more particularly to a system for preventing entanglement of lift cords used in such coverings for raising and lowering horizontal rails in the covering between extended and retracted positions.

2. Description of the Relevant Art

Retractable coverings for architectural openings have been in use for many years. Early forms of such retractable coverings were referred to as Venetian blinds wherein a plurality of horizontally disposed, vertically spaceable slats are supported on cord ladders and utilize a control system that allows the slats to be raised or lowered to move the covering between retracted and extended positions relative to the architectural opening in which the covering is mounted. The slats can also be tilted about horizontal longitudinal axes to move the covering between open and closed positions.

More recently, cellular shades have been developed wherein horizontally or vertically disposed cells that are transversely collapsible, extend between horizontal or vertical rails, respectively, so that by moving the rails toward or away from each other, the covering can be retracted or extended across the architectural opening.

Retractable coverings utilizing horizontal rails for extending and retracting the covering usually employ lift cord systems for raising or lowering one or more rails to effect extension or retraction of collapsible shade material that interconnects the rails. In early retractable coverings or shades, one edge of the collapsible shade material would be secured to a headrail that also included a control system for the covering while the opposite edge of the shade material was connected to a movable bottom rail which could be raised or lowered by the control system to retract or extend the covering, respectively. In other words, by lifting the lower rail toward the headrail, the shade material would collapse therebetween until the covering was fully retracted. By lowering the bottom rail, the shade material would extend across the architectural opening.

As an evolution of such retractable shades, top down/bottom up coverings have been developed, which typically include a headrail, a movable top rail and a movable bottom rail with a shade material extending between the top and bottom rails. The control system for such coverings utilize sets of lift cords which can independently raise or lower the top and bottom rail so that the covering becomes a top down covering by lowering the top rail toward the bottom rail, or a bottom up covering by raising the bottom rail toward the top rail. Further, the rails can be positioned at any elevation within the architectural opening and with any selected spacing between the top and bottom rails for variety in positioning of the shade material across the architectural opening.

The problem encountered with such retractable coverings resides in the fact that the lift cords themselves are typically wrapped around spools within the headrail and when one movable rail is moved past a position occupied by another movable rail, the lift cords sometimes become entangled on their associated spools causing malfunctioning of the covering. While efforts have been made to avoid such entanglement, efforts are still being made to deal with this problem, and the present invention has been developed as a remedy.

SUMMARY OF THE INVENTION

A cord tension control system pursuant to the present invention has been designed to avoid entanglement of lift cords about their wrap spools within a headrail of a retractable covering of the top down/bottom up type. The invention addresses the problem by providing pairs of adjacent threaded rods adapted to rotate in unison with wrap spools with which they are associated and with the wrap spools further being associated with a particular rail to which collapsible shade material is attached. As a rail is raised or lowered with an associated lift cord, thus effecting rotation of a cord spool and the wrapping of a lift cord thereabout, a threaded shaft rotates in unison therewith and includes an abutment nut which translates along the length of the threaded shaft as it rotates. Pairs of the threaded shafts, with one shaft of each pair being associated with each rail, are closely enough positioned so that the abutment nuts on each shaft will engage each other at preselected positions of the nuts so that movement of one rail past another can be avoided at any desired relative location of the rails thus avoiding entanglement of the lift cords associated with each wrap spool.

Other aspects, features and details of the present invention can be more completely understood by reference to the following detailed description of the preferred embodiments, taken in conjunction with the drawings and from the appended claims.

DETAILED DESCRIPTION OF THE INVENTION

Figure 2:
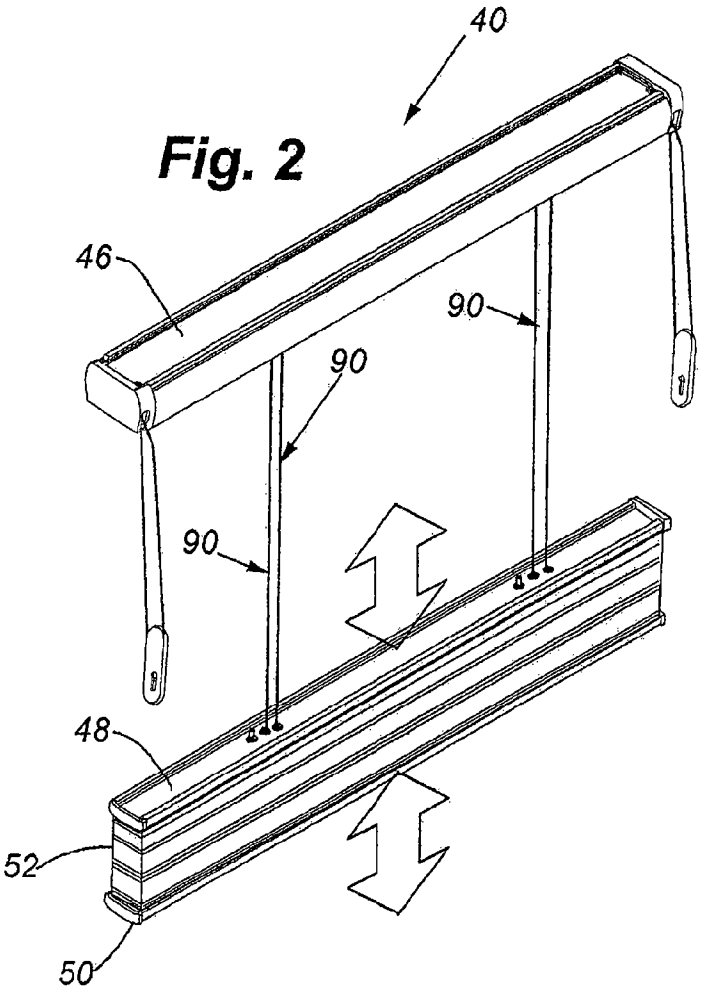
FIG. 2 is an isometric similar to FIG. 1 with a top rail of the covering having been lowered.
Figure 1:
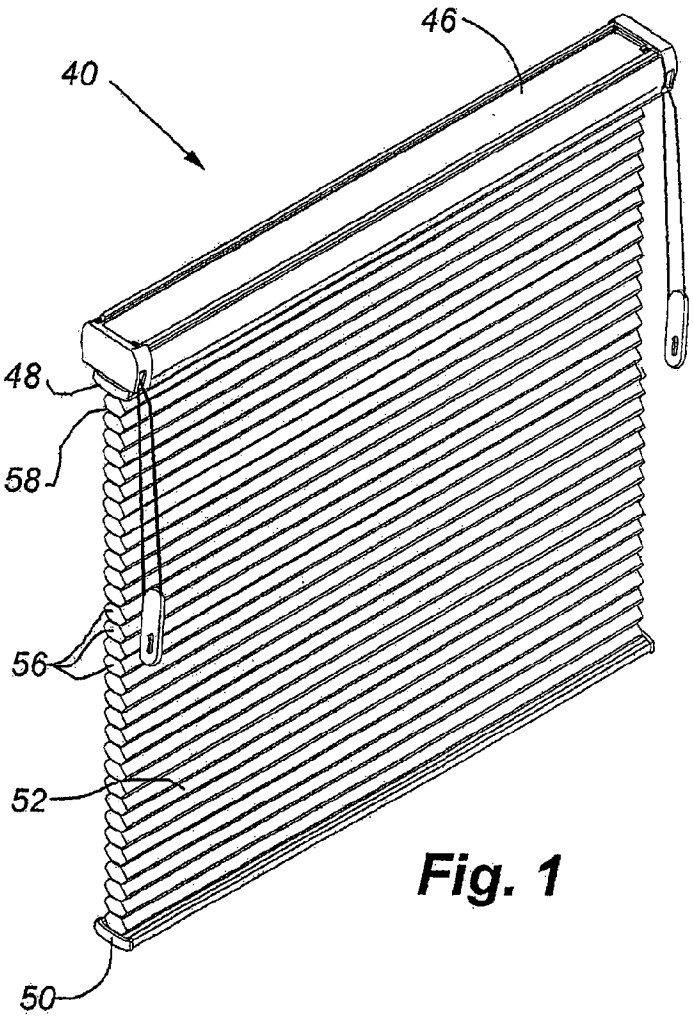
FIG. 1 is an isometric of a top down/bottom up covering shown in a fully-extended condition and incorporating the cord tension control system of the present invention.

FIGS. 1-16D illustrate an arrangement of a top down/bottom up covering 40 for use in an architectural opening 42 (FIGS. 5A-5D) wherein the covering incorporates the first embodiment 64 of a cord tensioning system in accordance with the present invention. As best seen in FIGS. 1-4, the top down/bottom up covering has a headrail 46, a top rail 48, a bottom rail 50, a collapsible shade material 52 positioned between and interconnecting the top rail and the bottom rail, and a control system 54 for independently raising and lowering the top rail and bottom rail. While the shade material could be any transversely collapsible material, it is illustrated for purposes of the disclosure as a panel comprised of a plurality of horizontally extending, longitudinally connected cells 56, which are transversely collapsible so that the panel can be fully extended as shown in FIG. 1 or fully retracted as shown in FIG. 2. A top edge 58 of the panel or shade material is secured along its length to the bottom surface of the top rail in any conventional manner such as with the use of an anchor strip 60 (FIG. 3B), positioned within the uppermost cell, and trapped within a channel (not seen) provided in the lower surface of the top rail. Similarly, the lowermost cell in the panel is attached to the top surface of the bottom rail with an anchor strip 62 insertable through the lowermost cell and trapped within a channel in the top surface of the bottom rail. In this manner, relative movement of the top rail and bottom rail, away from or toward each other, causes the panel of shade material to be expanded or retracted, respectively.

Figure 3A:
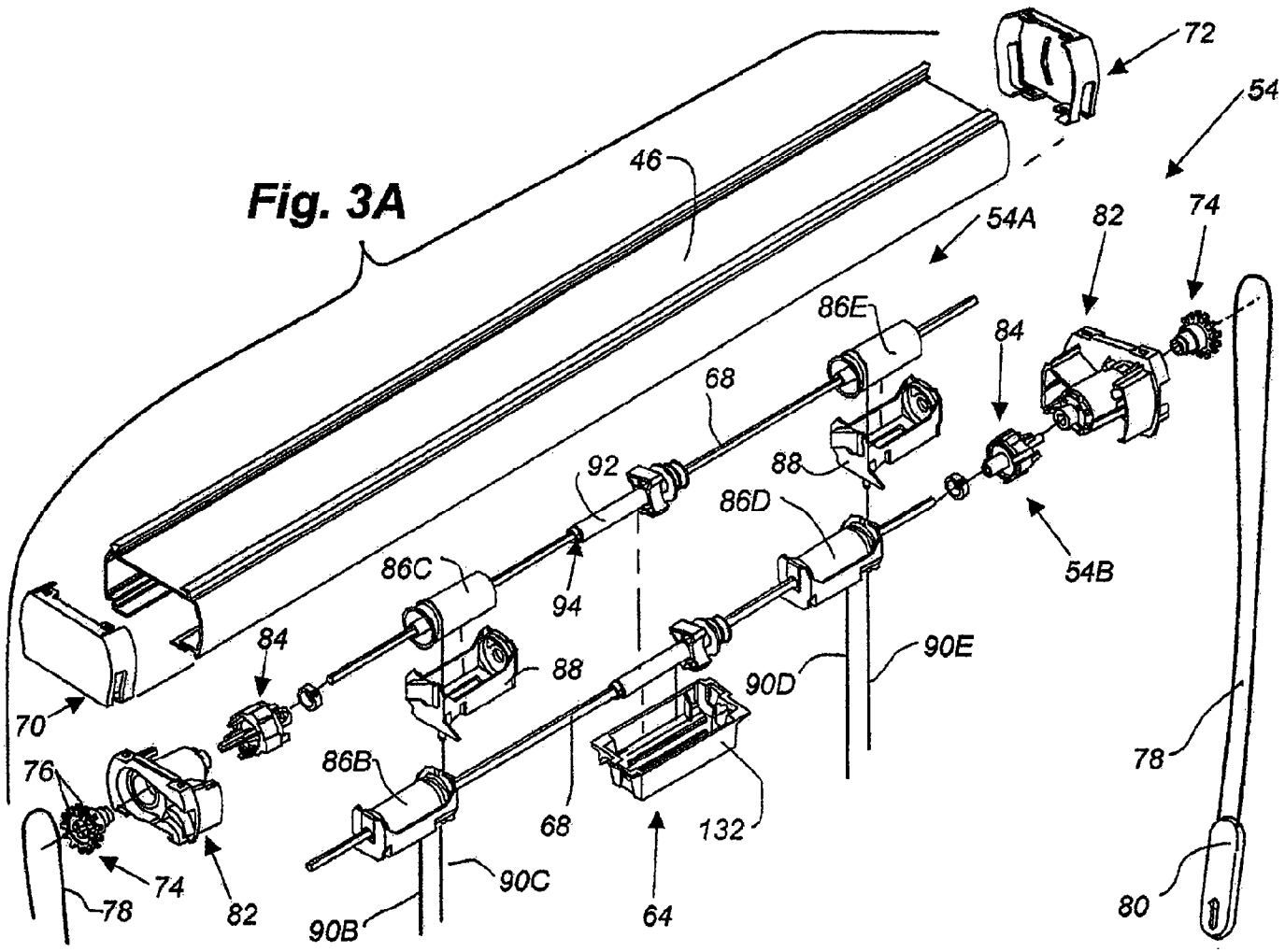
FIG. 3A is an exploded isometric of the headrail and control system used in the covering of FIGS. 1 and 2.
Figure 3B:
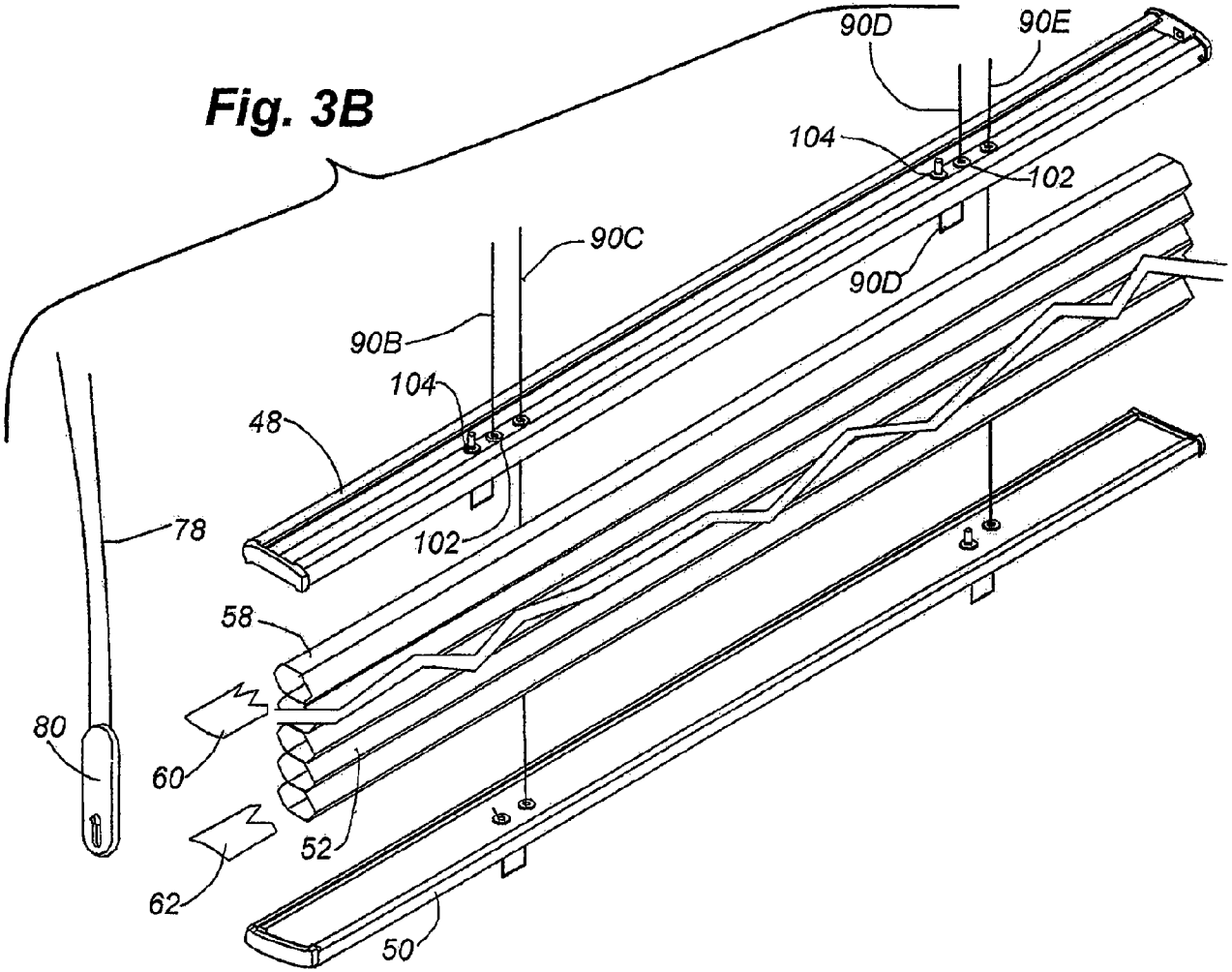
FIG. 3B is an exploded isometric showing the top and bottom rails and the collapsible fabric extending therebetween of the covering shown in FIGS. 1 and 2.
Figure 4:
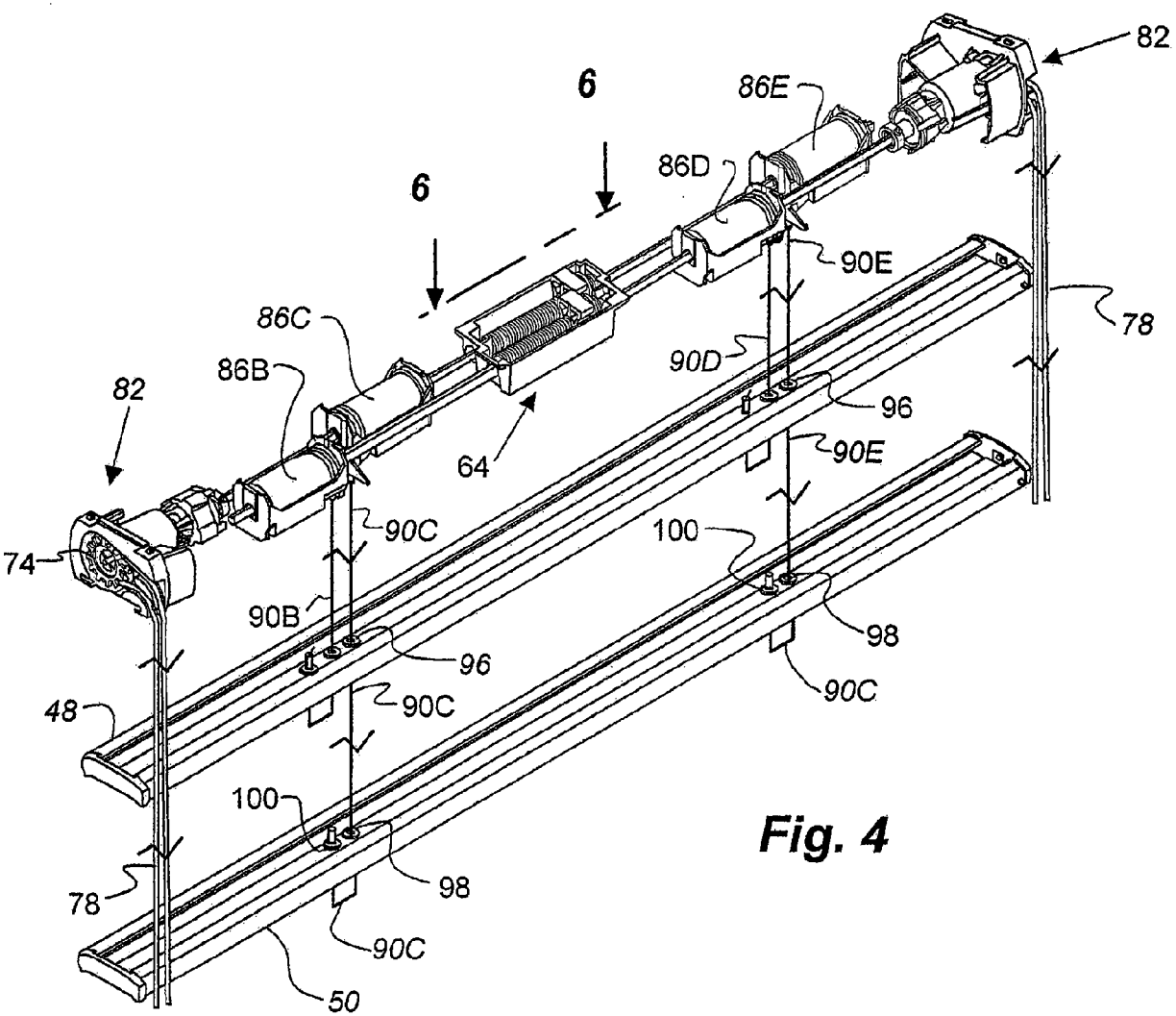
FIG. 4 is an isometric with parts removed showing the components of the covering illustrated in FIGS. 3A and 3B.

The top 48 and bottom 50 rails of the covering are raised and lowered while remaining horizontally disposed and parallel with each other by the control system 54 seen best in FIGS. 3A and 4. As will be appreciated with the description that follows, the control system includes two identical components 54A and 54B, which are reversed within the headrail, with one component 54B raising and lowering the top rail 48 and the other 54A the bottom rail 50. For purposes of simplicity, only one of those components 54A will be described in detail. The tension control system 64 of the present invention integrates the two components 54A and 54B of the control system in a manner to be described hereafter to provide a positive control system, which prevents entanglement of lift cords 90 which form a part of each component of the control system.

With reference to FIG. 3A, the control system component 54A shown to the left or above the other component will be described and can be seen to include an elongated horizontally disposed drive shaft 68 of non-circular cross-section which extends substantially from one end cap 70 of the headrail to an opposite end cap 72. At the left end cap 70, a drive pulley 74 is provided having a circumferential channel defined by a plurality of radially extending gripping teeth 76 so that an endless control cord 78 positioned within the channel can rotate the drive pulley in either direction by circulating the control cord in one direction or the other. The control cord has a tassel 80 incorporated therein to facilitate circulation of the control cord by an operator of the system. As will be appreciated, one control system component 54A has its circulating control cord 78 at the left end of the headrail 46 while the other control system 54B component has its control cord at the right end of the headrail.

The drive pulley 74 is operatively journaled within a conventional brake or two-way clutch 82 so that when the control cord 78 associated with the drive pulley is not being circulated in one direction or another, the brake retains the drive pulley in a fixed position. Movement of the control cord in one direction or the other releases the brake to permit the desired rotation as long as the control cord is being circulated. An example of such a brake can be found in U.S. Pat. No. 7,571,756, which is of common ownership with the present application, and the disclosure in which is hereby incorporated by reference.

At the output end of the brake 82, a gear reduction unit 84 is provided to reduce the output speed of rotation in relation to the input speed. In other words, a full rotation of the input to the gear reduction unit might generate one-third or one-half of a rotation at the output end. Such gear reduction units may or may not be necessary depending upon the weight of the shade material and the width of the covering as dictated by the length of the headrail 46. If the gear reduction unit is utilized, it could be of a conventional type which is well known in the art.

The output end of the gear reduction unit 84 receives the left end of the non-circular drive shaft 68 so as to rotate the drive shaft at a predetermined rate of rotation dependent upon the rate of rotation of the drive pulley 74. Rotation of the drive shaft rotates a conventional cord wrap spool 86C, which is mounted on the shaft for unitary rotation therewith and is rotatably seated within a cradle 88 fixed within the headrail 46 in a conventional manner. A typical wrap spool and cradle can be found and disclosed in detail in the aforenoted U.S. Pat. No. 7,571,756, which is of common ownership with the present application, and the disclosure in which is hereby incorporated by reference. Suffice it to say that the cord wrap spool anchors one end of a lift cord 90C whose opposite end supports the bottom rail 50 so that as the bottom rail is raised or lowered by rotation of the spool, the lift cord associated therewith is wrapped about or unwrapped from the spool. The spool is designed to automatically shift axially as the lift cord material is wrapped thereabout to prevent entanglement, but as will be appreciated, under some conditions if the spool is overwrapped or underwrapped, the associated lift cord can become entangled. It is the cord tension control system of the present invention that has been designed to reduce the possibility of such entanglement.

To the right of the previously described wrap spool 86C and also mounted on the drive shaft 68 for unitary rotation therewith is a threaded shaft element 92 of the cord tension system 64 of the present invention, which will be described in more detail hereafter. Suffice it to say that the threaded shaft element has a longitudinal passage 94 therethrough of the same non-circular cross-section as the drive shaft so that the threaded shaft rotates in unison with the drive shaft.

The drive shaft 68 supports a second cord wrap spool 86E on the opposite side of the cord tension system 64 from the cord wrap spool 86C previously described with the second cord wrap spool being identical to the first and again rotatably seated in a cradle 88 secured within the headrail 46. A lift cord 90E associated with the second wrap spool is connected to the bottom rail as the lift cord 90C emanating from the first cord wrap spool. For purposes of the present disclosure and as will be described in more detail hereafter, the lift cords 90C and 90E associated with the wrap spools 86C and 86E, respectively, previously described extend downwardly and are secured to the bottom rail 50 to effect raising and lowering of the bottom rail depending upon the direction of rotation of the drive shaft 68 and consequently the wrap spools 86C and 86E operatively associated therewith. The right end of the drive shaft, as shown in FIG. 3A, is journaled in the end cap 72 at the right end of the headrail 46 in any conventional manner so that the drive shaft is supported within the headrail for bidirectional rotation depending upon the direction of circulation of the control cord 78 associated therewith.

With reference to FIG. 4, the lift cords 90C and 90E associated with the first and second cord wrap spools 86C and 86E, respectively, previously described can be seen extending downwardly from their associated wrap spools through a grommet 96 in the top rail 48 and subsequently downwardly to the bottom rail 50 where they extend through a first grommet 98 and then back upwardly through a second grommet 100 where the end of the lift cord can be knotted or otherwise provided with an attachment to the bottom rail. In this manner, it will be seen that rotation of the previously described drive shaft 68 and the associated wrap spools 86C and 86E in one direction or the other will cause the bottom rail to raise or lower independently of the top rail.

The control system component 54B, which has not been specifically described but which is shown in FIG. 3A to the right of the previously described control system component 54A, has its cord wrap spools 86B and 86D supporting lift cords 90B and 90D, which extend downwardly from the first and second lift spools of the second control system component and are extended through a first grommet 102 in the top rail and subsequently upwardly through an adjacent grommet 104 where the end of the cords 90B and 90D can be knotted or otherwise secured to the top rail 48 such that rotation of the second component of the control system, which is independent of the first component, will cause the top rail to raise or lower as the lift cords 90B and 90D are wrapped or unwrapped from their associated spools 86B and 86D, respectively.

Figure 5B:
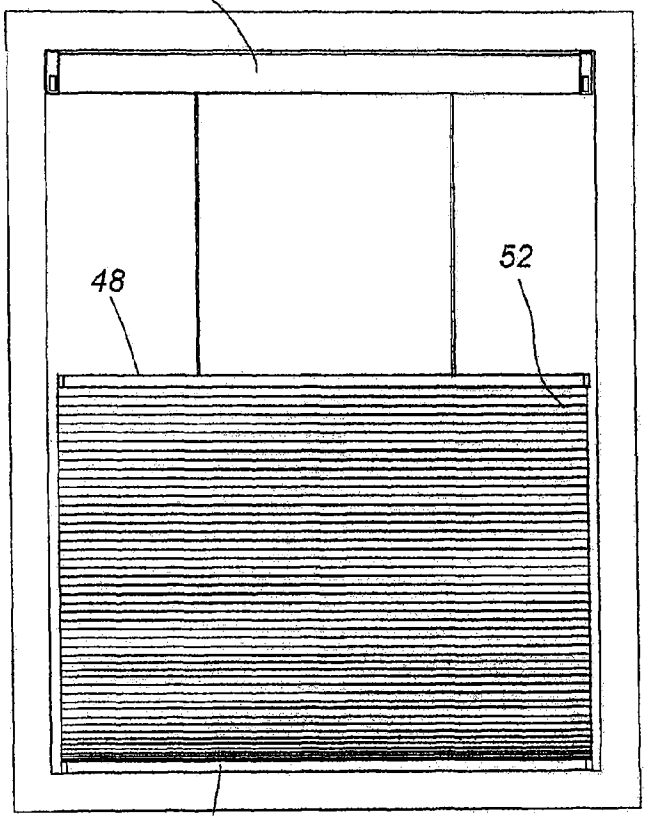
FIG. 5B is a front elevation similar to FIG. 5A with the top rail having been lowered while maintaining the bottom rail adjacent the bottom of the architectural opening.
Figure 5A:
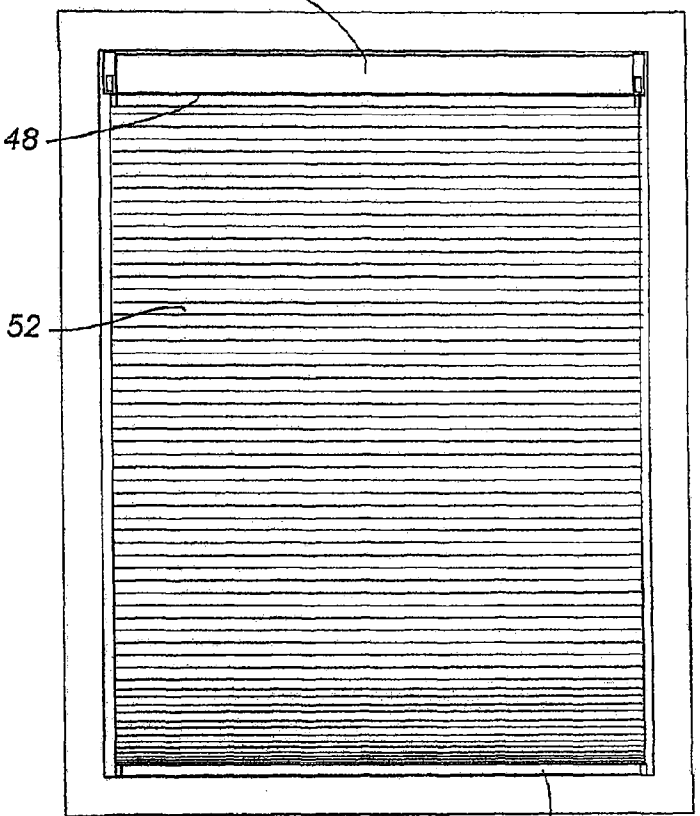
FIG. 5A is a front elevation of the covering of FIGS. 1 and 2 positioned within an architectural opening and in the fully-extended position of FIG. 1 with the top rail adjacent the headrail, and the bottom rail adjacent the bottom of the architectural opening.
Figure 5D:
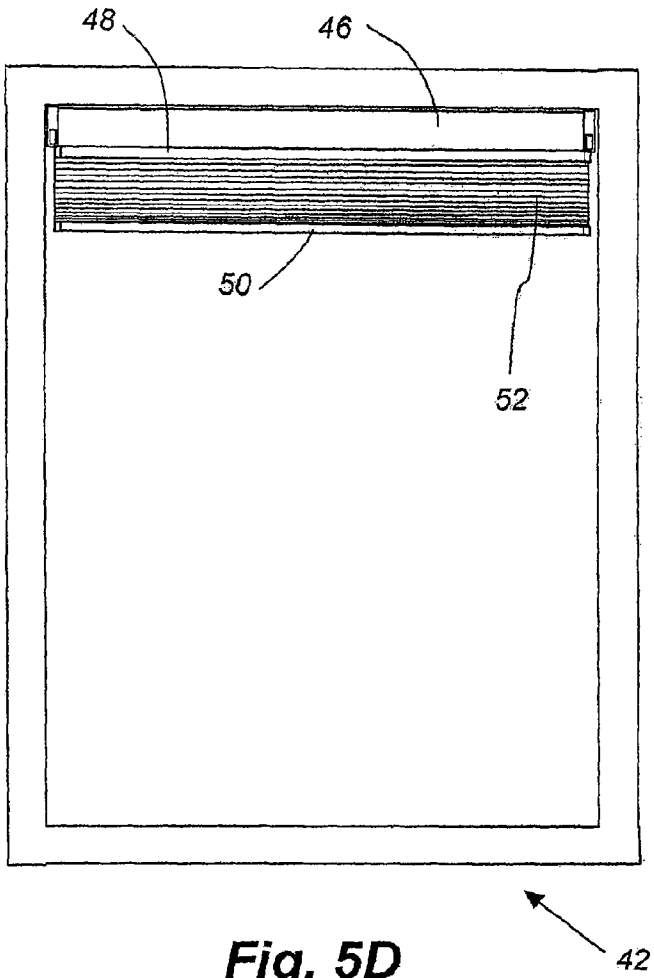
FIG. 5D is a front elevation similar to FIG. 5A with the bottom rail having been raised fully to place the covering in a fully retracted condition.
Figure 5C:
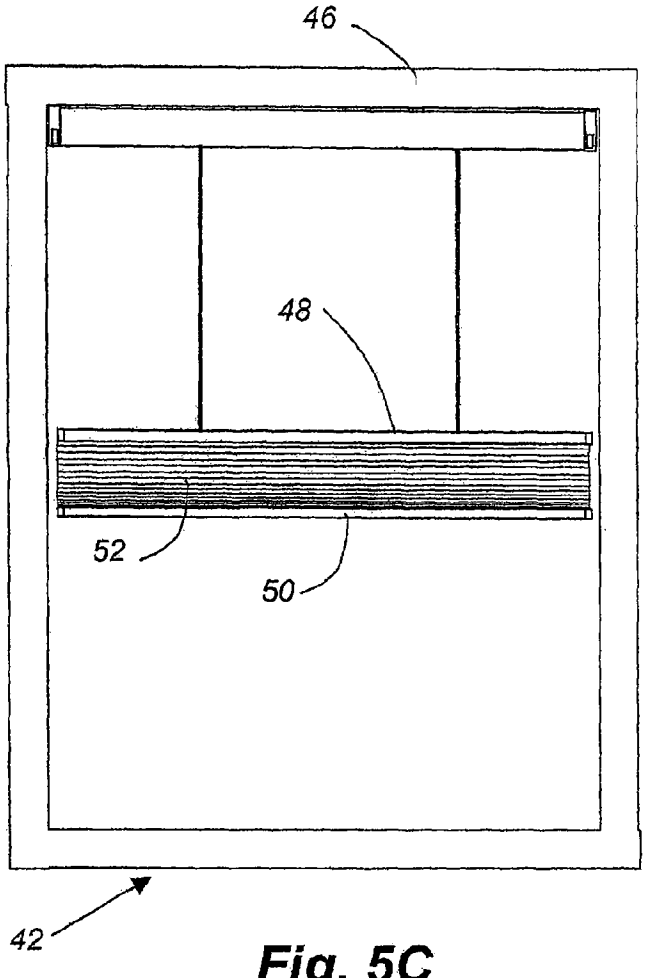
FIG. 5C is a front elevation similar to FIG. 5B with the bottom rail having been raised into closely spaced relationship with the lowered top rail.

From the above, it will be appreciated that if an operator wanted to raise or lower the bottom rail 50 while leaving the top rail 48 unmoved, the first component 54A of the control system would be operated by rotating its associated control cord 78. The top rail can be raised or lowered identically by circulating its associated control cord. In this manner, the shade material 52 can be positioned in an infinite number of conditions between the top and bottom rails with four of those conditions illustrated in FIGS. 5A-5D. In FIG. 5A, the shade is fully extended across the architectural opening 42 in which it is mounted by lowering the bottom rail to the bottom of the opening and raising the top rail adjacent to the headrail 46 of the covering. In FIG. 5B, the bottom rail is left at the bottom of the architectural opening while the top rail has been lowered approximately half way across the opening. FIG. 5C illustrates the top rail having been left in the position shown in FIG. 5B but the bottom rail having been raised into adjacent relationship with the top rail. FIG. 5D shows the top rail positioned at the top of the opening, and the bottom rail moved into adjacent relationship therewith so that the covering is fully retracted in a raised position.

Looking now specifically at the cord tensioning system of the present invention, which is provided to prevent entanglement of the lift cords 90 upon operation of the control cords 78, it will be appreciated from the above description that each control system component 54A and 54B has a component of the cord tensioning system in the form of an identical threaded shaft 92 mounted on an associated drive shaft 68 for unitary rotation therewith. Each threaded shaft is probably best seen in FIGS. 14 and 15 to include a threaded main body 106 with a reduced diameter small end 108 at one end of the threads and an enlarged end 110 at the opposite end of the threads. The longitudinal passage 94 is shown through the entire length of the threaded shaft of non-circular cross-section which is correlated with the cross-section of the drive shaft to provide unitary rotation of the threaded shaft with the drive shaft on which it is mounted. The enlarged end of each threaded shaft has a large ring 112 integrally formed thereon at a short spacing from the associated end of the threaded shaft and at a spaced distance from the large ring toward the opposite small end of the threaded shaft is an integral middle or intermediate ring 114. Spaced from the intermediate ring, again toward the opposite small end of the threaded shaft, is an integral inner ring 116 of the same diameter as the middle ring with the face of the inner ring closest to the small end of the threaded shaft having a radial tapered tooth or catch 118 formed thereon for a purpose to be described hereafter. As probably best seen in FIG. 3A, the enlarged end 110 of each threaded shaft is positioned on its associated drive shaft 68 so as to be at the right end of the threaded shaft as viewed in FIG. 3A.

Each threaded shaft 92 has an identical abutment nut 120 threaded thereon with the abutment nut having a threaded passage 122 therethrough for threaded receipt on the threaded shaft, and enlarged upper 124 and lower 126 ends. A longitudinal groove 128 is provided in the lower surface of the lower end for a purpose to be described hereafter, and a catch block 130 is affixed to the face of the abutment nut facing the enlarged end 110 above the threaded passage 122 so as to confront the opposing face of the inner ring 116 having the catch 118 formed thereon. In this manner, the catch can abut the block when the abutment nut is positioned adjacent to the inner ring to positively prevent further rotation of the threaded shaft in one direction.

Figure 6:
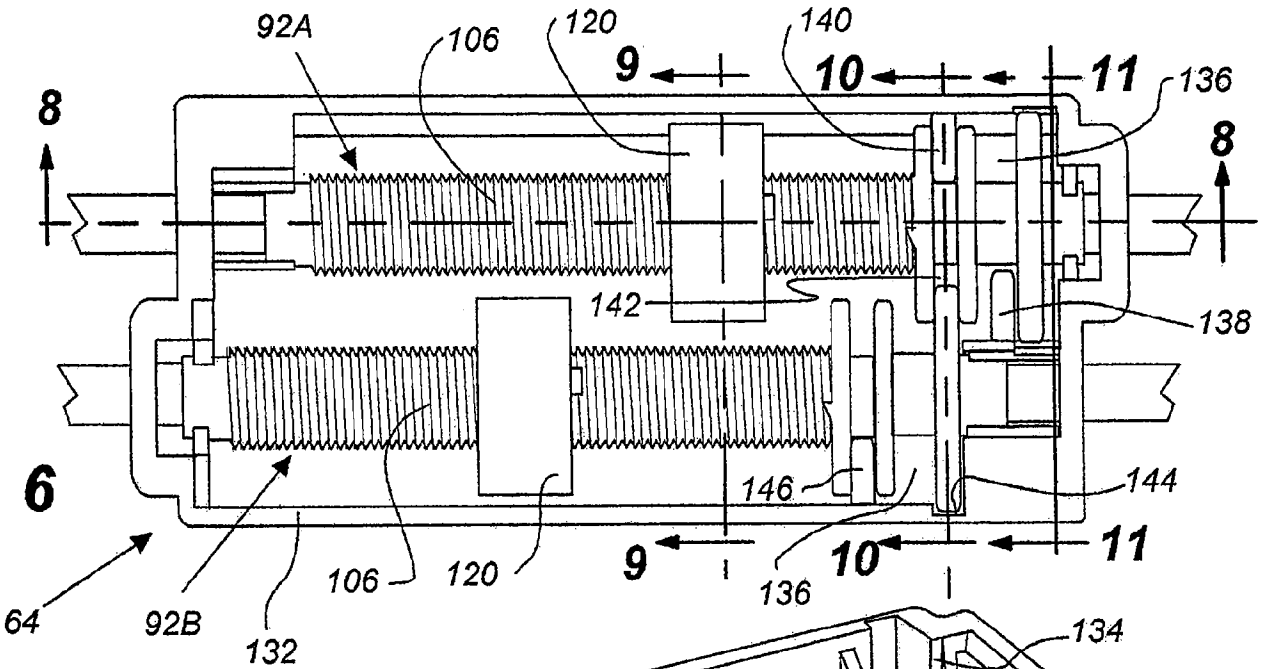
FIG. 6 is an enlarged fragmentary view taken along line 6-6 of FIG. 4.
Figure 7:
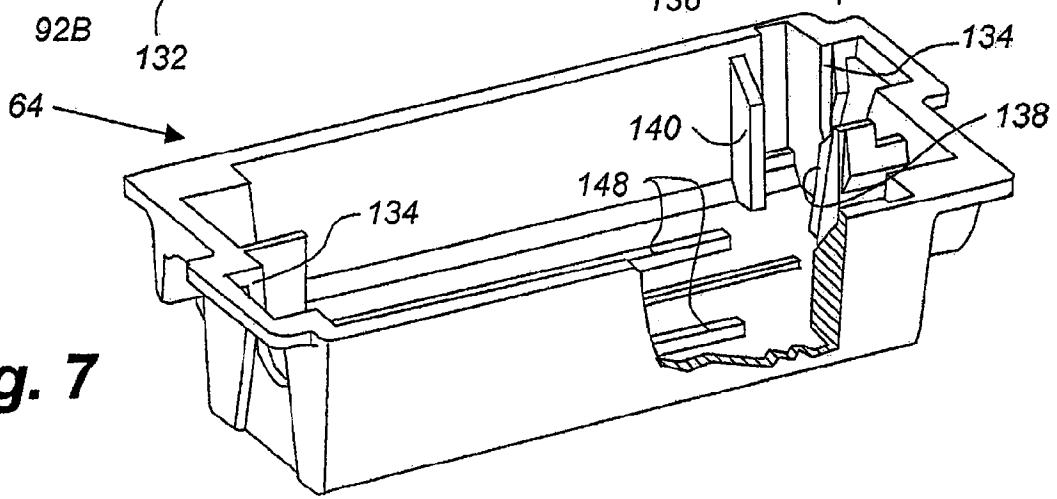
FIG. 7 is a top isometric with parts removed of the open topped housing component of the cord tension control system of the invention.

With reference to FIGS. 3A, 6, and 7, each threaded shaft 92 can be seen to be rotatably positioned within an open topped housing 132 which is connected in any suitable manner to the headrail 46 so as to be non-movable relative thereto. The open topped housing rotatably supports each threaded shaft at opposite ends thereof with cradles 134 formed interiorly of the housing at opposite ends thereof. The threaded shafts are displaced longitudinally of each other a small distance as possibly best appreciated by reference to FIG. 6. Looking first at the uppermost shaft 92A as viewed in FIG. 6 or the shaft to the left, as viewed in FIG. 3A, a space or circumferential groove 136 defined between the large ring 112 and the middle ring 114 of the threaded shaft receives a guide finger 138 formed in the housing to prevent the threaded shaft from shifting significantly longitudinally to the left as viewed in FIG. 6. A similar finger 140 is formed on the wall of the housing to protrude into a circumferential space 142 defined between the middle ring and the inner ring 116 to assist in preventing longitudinal translation of the threaded shaft particularly as it is rotated. With reference to the lower threaded shaft 92B, as seen in FIG. 6, or the threaded shaft to the right, as viewed in FIG. 3A, it will be seen that its large ring 112 is guided within a groove 144 provided in the inner surface of the housing, and another finger 146 is formed in the adjacent wall of the housing that protrudes into the annular space 142 between the middle ring 114 and the inner ring 116 to prevent the associated threaded shaft from shifting longitudinally or axially particularly during rotation of the threaded shaft. It can also be appreciated in FIG. 6 that the large ring of the lower threaded shaft protrudes into the gap 142 between the middle ring and the inner ring of the upper threaded shaft which further assures a positive axial relationship between the two threaded shafts so that they are always positively positioned axially relative to each other at the predetermined position desired which is illustrated in FIG. 6.

Figures 8, 9, 10, 11:
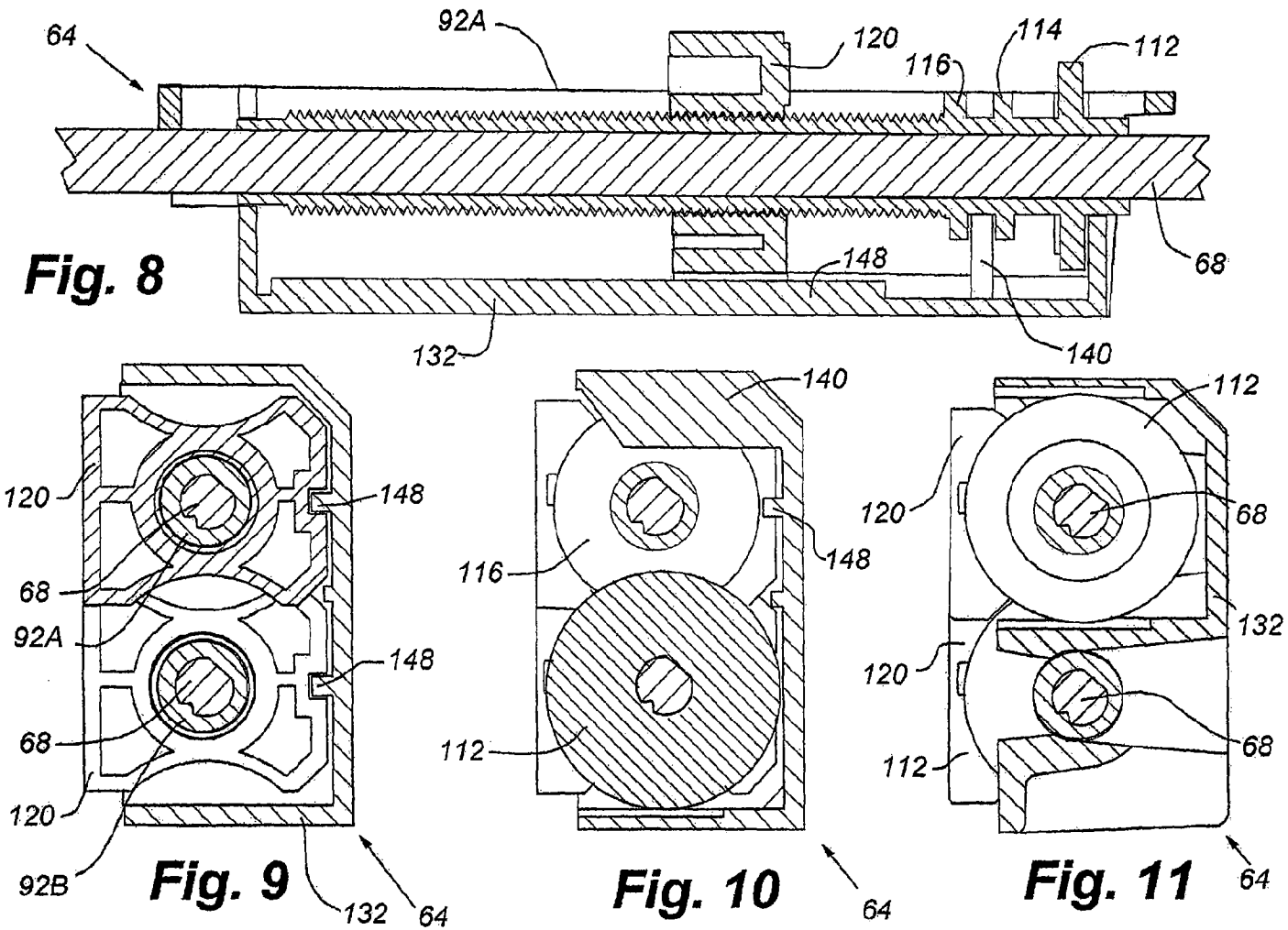
FIG. 8 is a section taken along line 8-8 of FIG. 6.
FIG. 9 is a section taken along line 9-9 of FIG. 6.
FIG. 10 is a section taken along line 10-10 of FIG. 6.
FIG. 11 is a section taken along line 11-11 of FIG. 6.
Figures 12, 13, 14, 15:
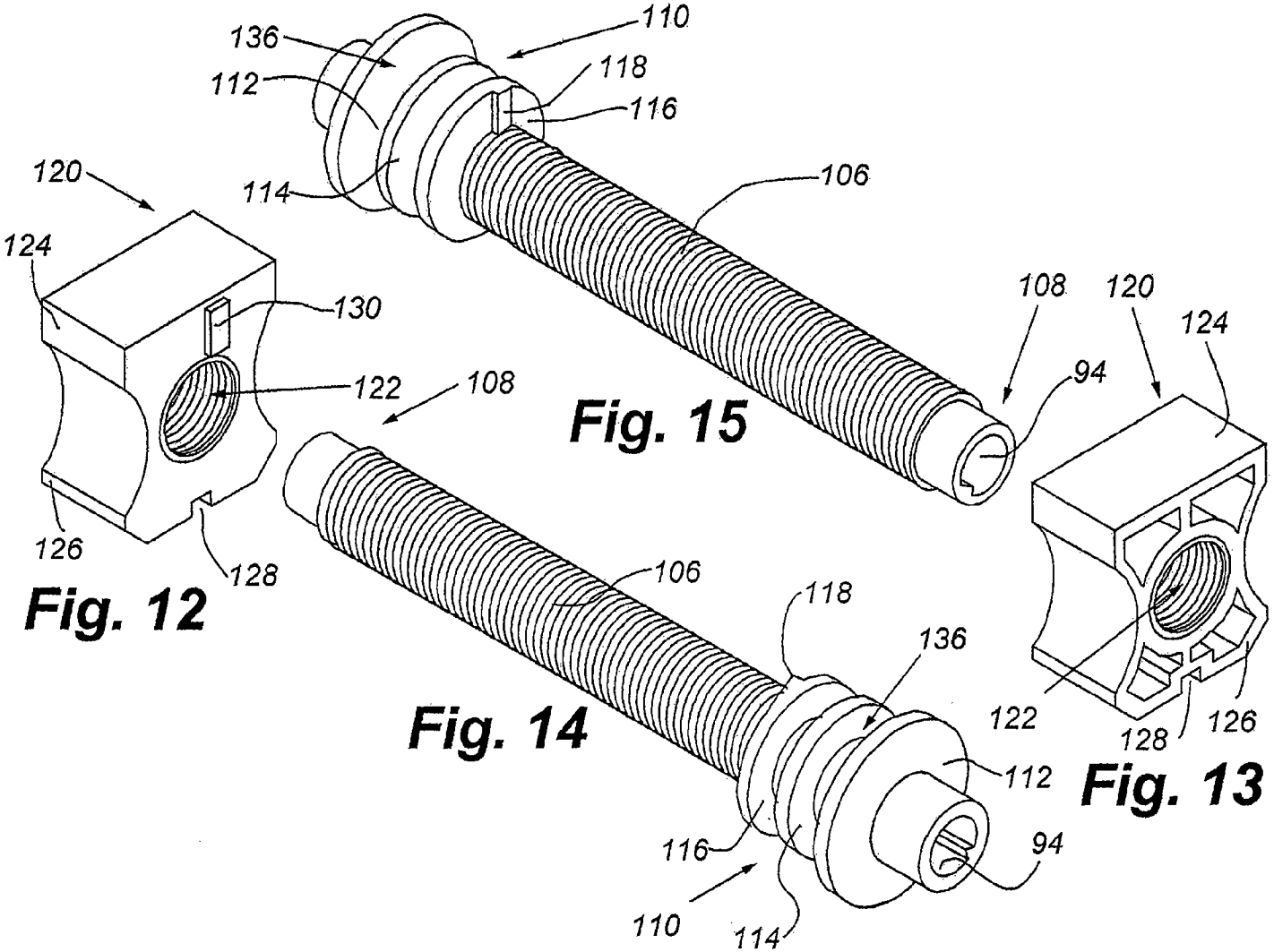
FIG. 12 is a front isometric looking downwardly on an abutment nut used in the cord tension system of the invention.
FIG. 13 is a rear isometric looking downwardly on the abutment nut of the cord tension system of the invention.
FIG. 14 is an isometric looking downwardly at the enlarged end of a threaded shaft component of the cord tension control system.
FIG. 15 is an isometric looking downwardly on the small end of the threaded shaft of the cord tension control system.

With reference to FIG. 9, each abutment nut 120 can be seen threadedly mounted on its associated threaded shaft 92 and slidably guided within the housing 132 by a longitudinal rib 148 extending inwardly along the bottom surface of the housing. The abutment nuts are therefor prevented from rotating upon rotation of their associated threaded shaft. Rather, the nuts are translated along the length of the threaded shafts depending upon the direction of rotation of the shafts. It should also be appreciated by reference to FIG. 9 that the abutment nuts laterally overlap each other so that they are incapable of passing by each other along the length of their associated threaded shafts. In this manner, when an abutment nut engages the other abutment nut, the threaded shafts are positively prevented from further rotation in a direction causing the abutment. Similarly, each abutment nut is positively prevented from further rotation toward the enlarged end 110 of the threaded shaft once the block 130 on the face of the abutment nut engages the catch or tooth 118 on the face of the inner ring 116. The operative engagement between the tooth and the block provide a positive means for immediately preventing further rotation of the threaded shaft even if the materials from which the nut and the shaft are made might be soft enough to allow some compression of the nut into the inner ring which would thus permit a slight degree of rotation beyond that desired.

It will be appreciated that the tension control device 64 of the invention is designed to maintain a very precise and positive control of rotation of the threaded shafts 92 and drive shafts 68 and therefore also the raising and lowering of the lift cords and their associated rails. This improves the control over the lift cords as they are wrapped around or unwrapped from their associated wrap spools, and without such positive control, entanglement of the lift cords has presented a problem in prior art systems. The entanglement normally occurs when one movable rail is moved toward the other and continues the movement thereby driving the second movable rail out of its position creating slack in the lift cords associated with the second rail which will sometimes create entanglement where the associated lift cords are wrapped around their associated cord wrap spools.

Due to the overlapping of the abutment nuts 120, it will be appreciated the control system components are operatively interrelated and by desirably and appropriately positioning the abutment nuts during assembly of the covering the desired control over the lift cords to prevent entanglement can be obtained as one rail can be prevented from engaging and driving the other rail out of position.

In order to best describe the operation of the system, FIGS. 5A-5D are correlated with FIGS. 16A-16D, respectively, to show the position of the abutment nuts 120 at the relative and corresponding positions of the top 48 and bottom 50 rails as illustrated in FIGS. 5A and 5D. Obviously, there are an infinite number of relative positions of the top and bottom rails, but for purposes of understanding the present invention, only four of those positions and thus conditions of the architectural covering 40 are illustrated.

Figure 16A:
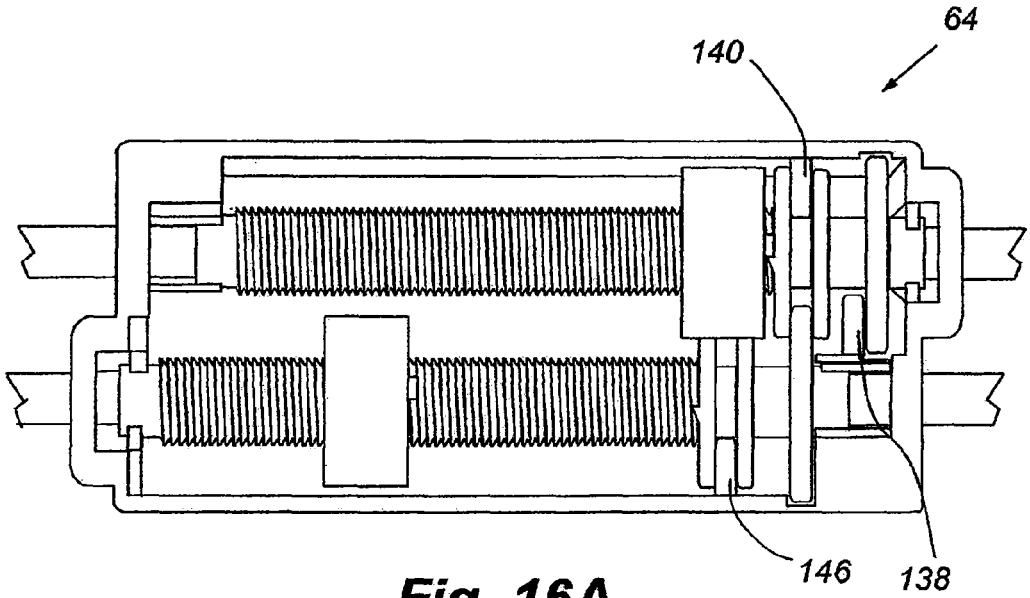
FIG. 16A is a top plan view looking downwardly on the cord tension control system of the invention showing the abutment nuts in the positions they would when the covering is disposed as shown in FIG. 5A.
Figure 16B:
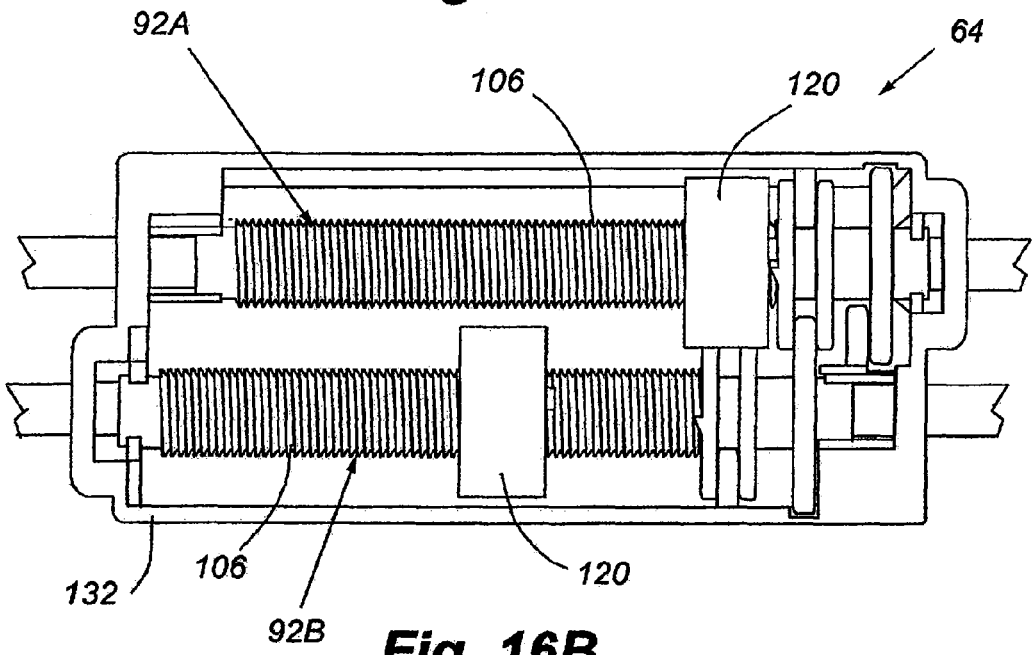
FIG. 16B is a top plan view showing the abutment nuts in the position they would assume when the covering is in the condition of FIG. 5B.
Figure 16C:
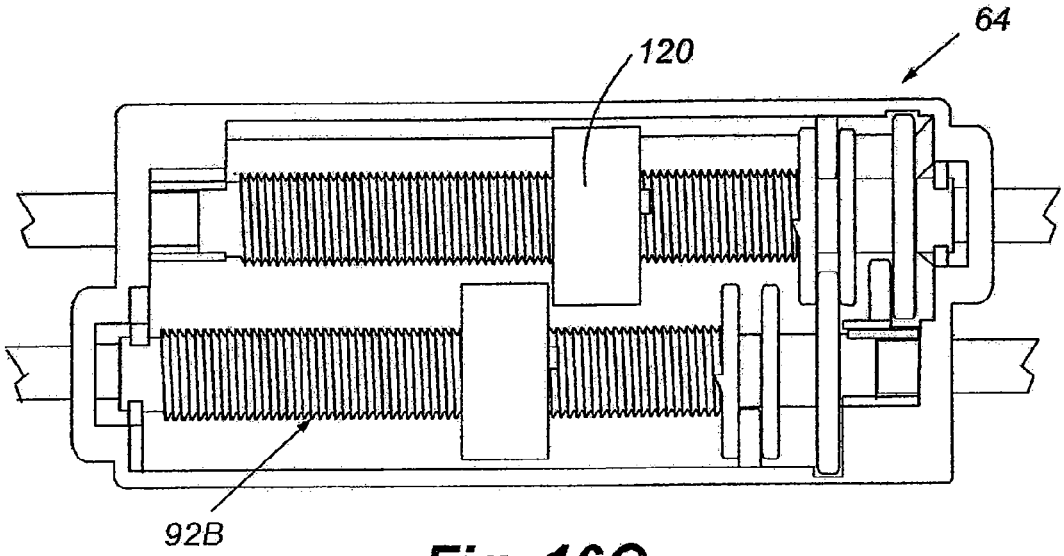
FIG. 16C is a top plan view of the cord tension control system with the abutment nuts assuming the position they would be in with the covering in the position illustrated in FIG. 5C.
Figure 16D:
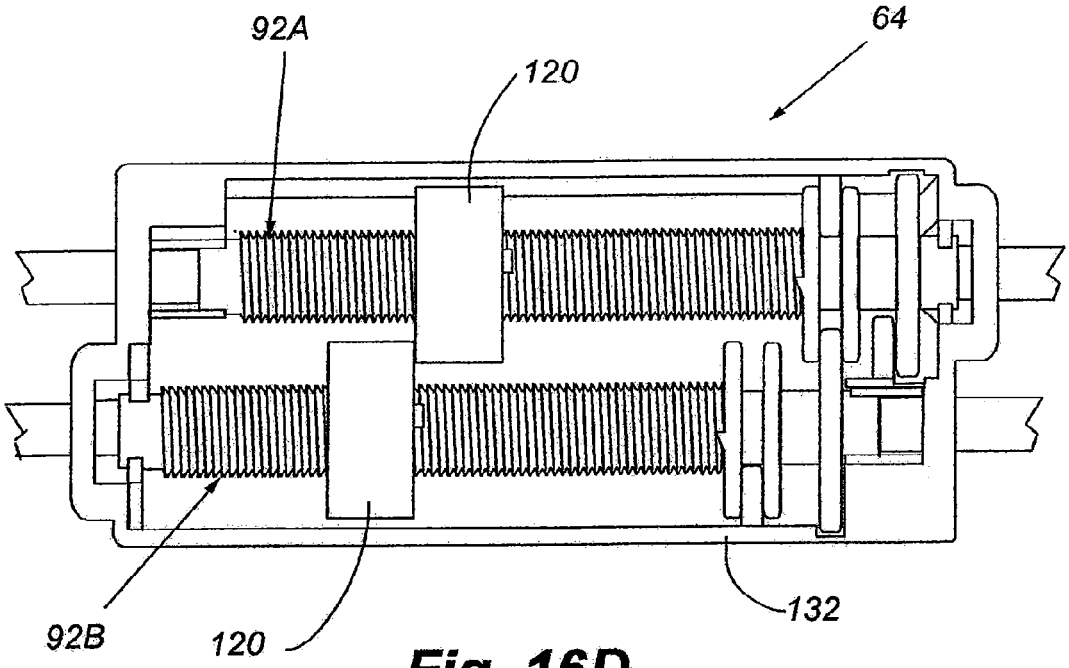
FIG. 16D is a top plan view showing the abutment nuts assuming the position in which they would be when the covering is in the condition illustrated in FIG. 5D.

As mentioned previously, the top threaded shaft 92A, as viewed in FIGS. 16A-16D, is associated with the bottom rail 50 so that rotation thereof causes the bottom rail to raise or lower. The bottom threaded shaft 92B, as viewed in FIGS. 16A and 16D, is associated with the top rail 48, and its rotation is correlated with the movement of the top rail. Looking first at FIGS. 5A and 16A, it will be appreciated the top rail is positioned at its extreme highest position adjacent to the headrail 46, and the position of the associated abutment nut is close to the left end of the associated threaded shaft 92B or the lower shaft, as viewed in FIG. 16A. The bottom rail is positioned at its extreme lowest position adjacent the bottom of the architectural opening, and its associated abutment nut is positioned at the right end of its associated threaded shaft 92A, or the upper threaded shaft, as viewed in FIG. 16A. Accordingly, the lower abutment nut can never be positioned further left than it appears in FIG. 16A as the top rail is as high as it can go and the abutment nut associated with the bottom rail is as far right as it can go inasmuch as the bottom rail is as low as it can possibly be.

Looking next at FIGS. 5B and 16B, it will be appreciated the bottom rail 50 is still at its extreme lowest position so that the abutment nut 120 associated therewith (the upper nut as viewed in FIG. 16B) has not moved and is at the right end of its threaded shaft 92A or the upper threaded shaft as viewed in FIG. 16B. The upper rail 48, however, has been lowered and as it is lowered its associated abutment nut (the nut on the lower threaded shaft as viewed in FIG. 16B) has been translated to the right.

Looking next at FIGS. 5C and 16C, the upper rail 48 remains at the location it was in FIG. 5B and, accordingly, its corresponding abutment nut 120 on the lower threaded shaft 92B, as viewed in FIG. 16C, is at the same position it occupied in FIG. 16B. The bottom rail 50, however, has been raised and as it is raised, its associated abutment nut on the top shaft 92A, as viewed in FIG. 16C, has been translated to the left and in fact has abutted the lower abutment nut so that no further rotation in that direction is possible. This, of course, gives a very positive stoppage of rotation of either threaded shaft which would cause their associated abutment nuts to move further toward each other and thus the associated cord wrap spools are also positively stopped from rotation which prevents further movement of either rail and possible entanglement of the lift cords associated therewith. By properly positioning the abutment nuts on their associated threaded shafts, the spacing between the upper and lower rails can be controlled regardless of where they are positioned within the architectural opening itself, and they can never be closer than the predetermined spacing, for example, illustrated in FIGS. 5C and 5D.

With reference to FIGS. 5D and 16D, it will be appreciated the upper rail 48 has been raised to the top of the opening 42 so that its associated abutment nut 120 (on the lower shaft 92B as viewed in FIG. 16D) has been translated to the position it occupied in FIG. 16A, and at the same time, the bottom rail 50 associated with the upper abutment nut 120, as viewed in FIG. 16D, has been raised to the desired closest spacing of the bottom rail to the top rail, which of course occurs, as mentioned previously, when the abutment nuts engage each other. The abutment of the abutment nuts, as mentioned previously, provides a very positive and abrupt system for preventing further rotation of the associated drive shafts so that further compression of the fabric between the upper and lower rails and worse yet undesirable movement of a rail out of position and therefore possible entanglement of the lift cords is avoided.

It will be appreciated from the above that a system has been employed for not only raising and lowering upper and lower rails of a top down/bottom up covering between infinitely variable positions, but also through use of the cord tensioning system described provides a very positive and immediate system for preventing undesired movement of the rails which can cause entanglements and thus malfunctioning of the covering.

Referring next to FIGS. 17A-30E, a second arrangement 150 of a top down/bottom up covering with a second embodiment 152 of a cord tension control system is illustrated. It will be appreciated from the description that follows, however, that a control system 154 including components 154A and 154B, but for the cord tension control portion 152 thereof, is identical to that previously described in that only two rails are movable within the covering even though the movable rails are associated with two distinct compressible panels 156 and 158 of shade material.

Figure 18:
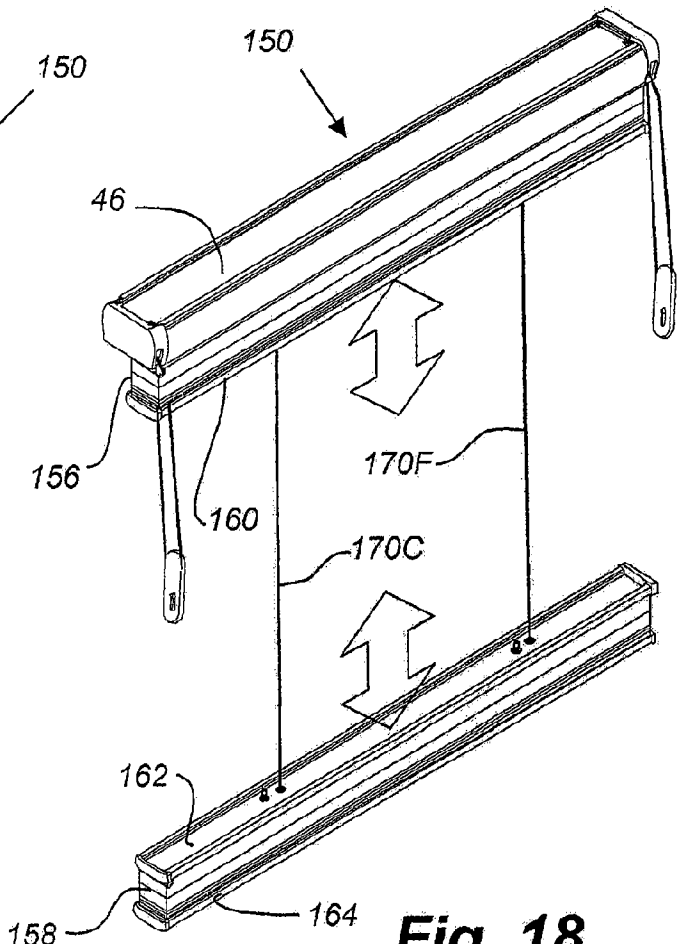
FIG. 18 is an isometric similar to FIG. 17A with the top rail being fully raised and the middle rail being fully lowered to place the covering in a fully retracted position.

Looking at FIGS. 17A-18, this arrangement 150 of the top down/bottom up covering can be seen to include a headrail 46 identical to that described in connection with the first arrangement, a top panel 156 of collapsible shade material, and a bottom panel 158 of collapsible shade material. The top panel 156 of shade material has its uppermost cell suspended from the headrail 46 in a conventional manner, such as with an anchor strip (not shown), and its bottom edge connected to a top rail 160 through use of an anchor strip through the lowermost cell of the top panel. The uppermost cell of the bottom panel 158 is connected to the lower surface of a middle rail 162, again with an anchor strip (not shown) or through any other suitable system, with the bottom or lowermost cell of the bottom panel being connected to a bottom rail 164 in a similar manner. The bottom rail of this arrangement of the covering is secured to the threshold 166 (FIGS. 21A-21E) of the framework of the architectural opening 42 so it never moves. Similarly, the headrail is mounted on suitable brackets (not shown) so it never moves. The top rail 160 and middle rail 162, however, are movable up and down relative to and independently of each other through a control system 154A or 154B of the type described in connection with the first arrangement of FIGS. 1-16D with the exception that the cord tension system 152 is a second embodiment thereof.

Figure 17A:
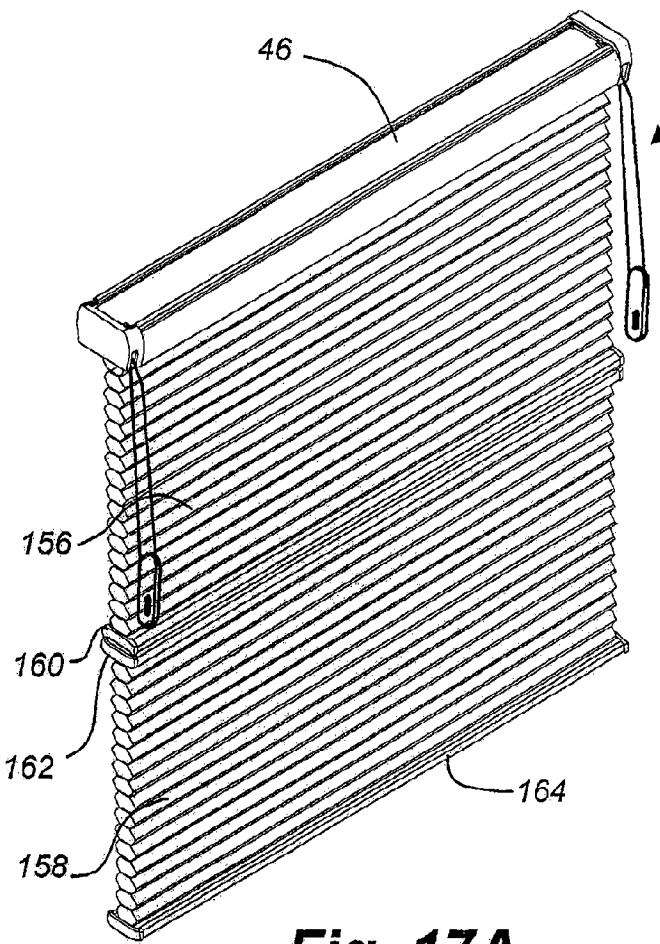
FIG. 17A is an isometric of a second embodiment of a retractable covering shown in a fully-extended condition and incorporating a second embodiment of the cord tensioning system of the present invention.
Figure 17B:
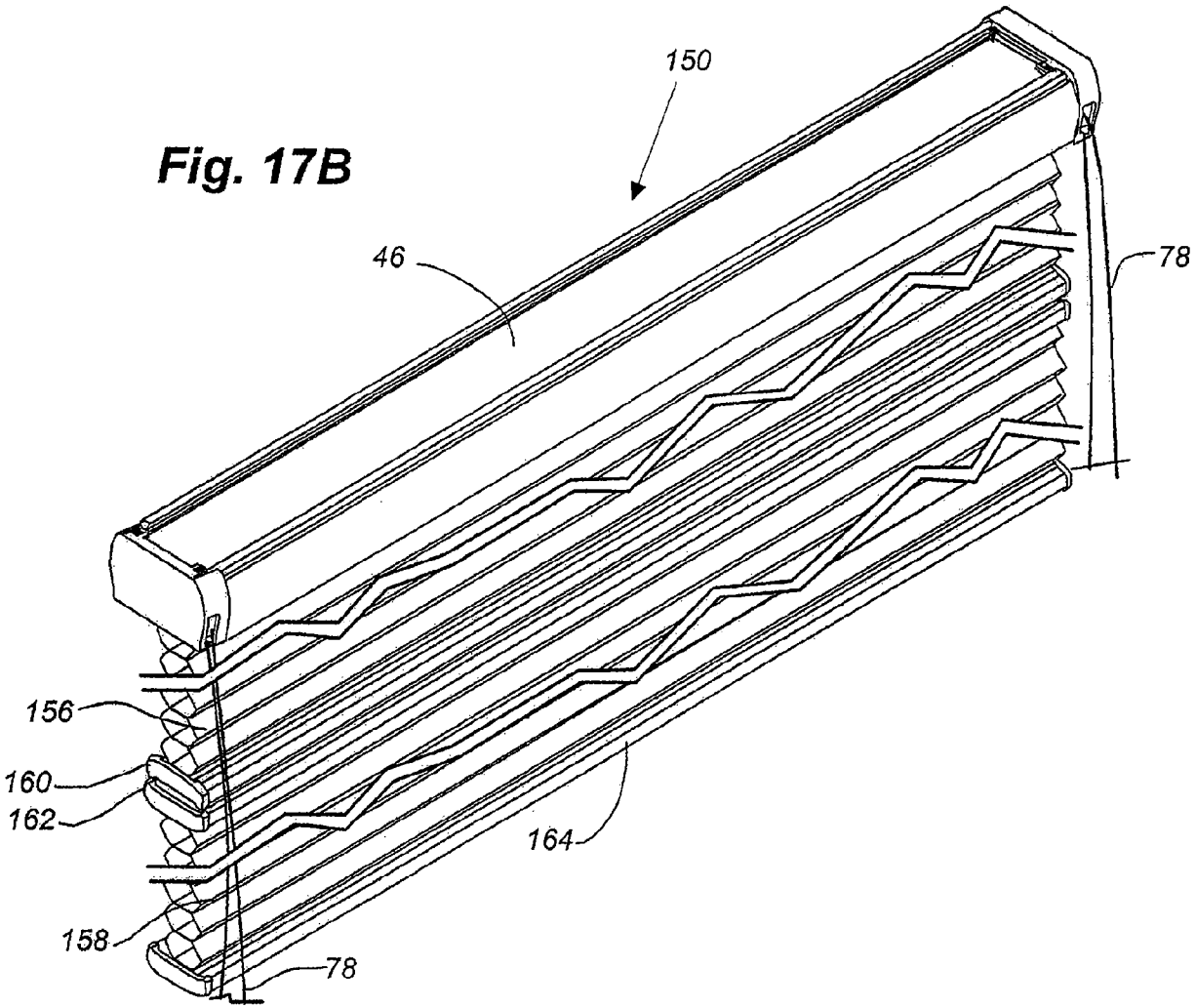
FIG. 17B is an enlarged isometric with portions removed showing the covering of FIG. 17A.

Referring to FIG. 17A, the covering 152 is fully extended with the top panel 156 fully extended and the bottom panel 158 fully extended in which position the top rail 160 is contiguous with the middle rail 162. FIG. 18 illustrates the top rail having been raised to retract the upper panel into a collapsed position adjacent the headrail 46, and the middle rail has been lowered to collapse the lower panel in a retracted position adjacent to the bottom rail 164. FIG. 17B is an enlarged drawing showing the covering in the position of FIG. 17A with portions removed due to size limitations.

Figure 19A:
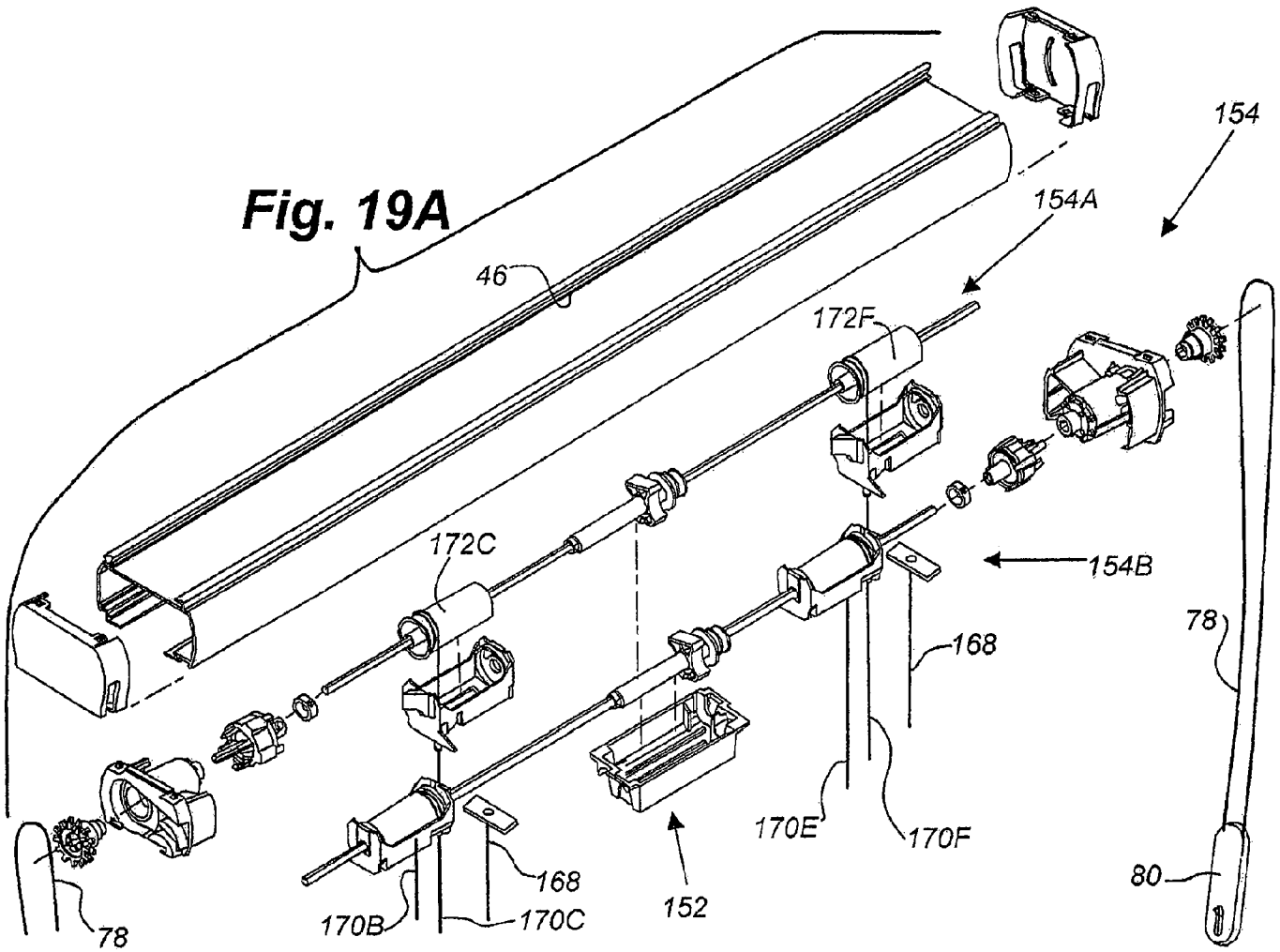
FIG. 19A is an exploded isometric of the headrail and the control system confined within the headrail for the covering illustrated in FIG. 17A.
Figure 19B:
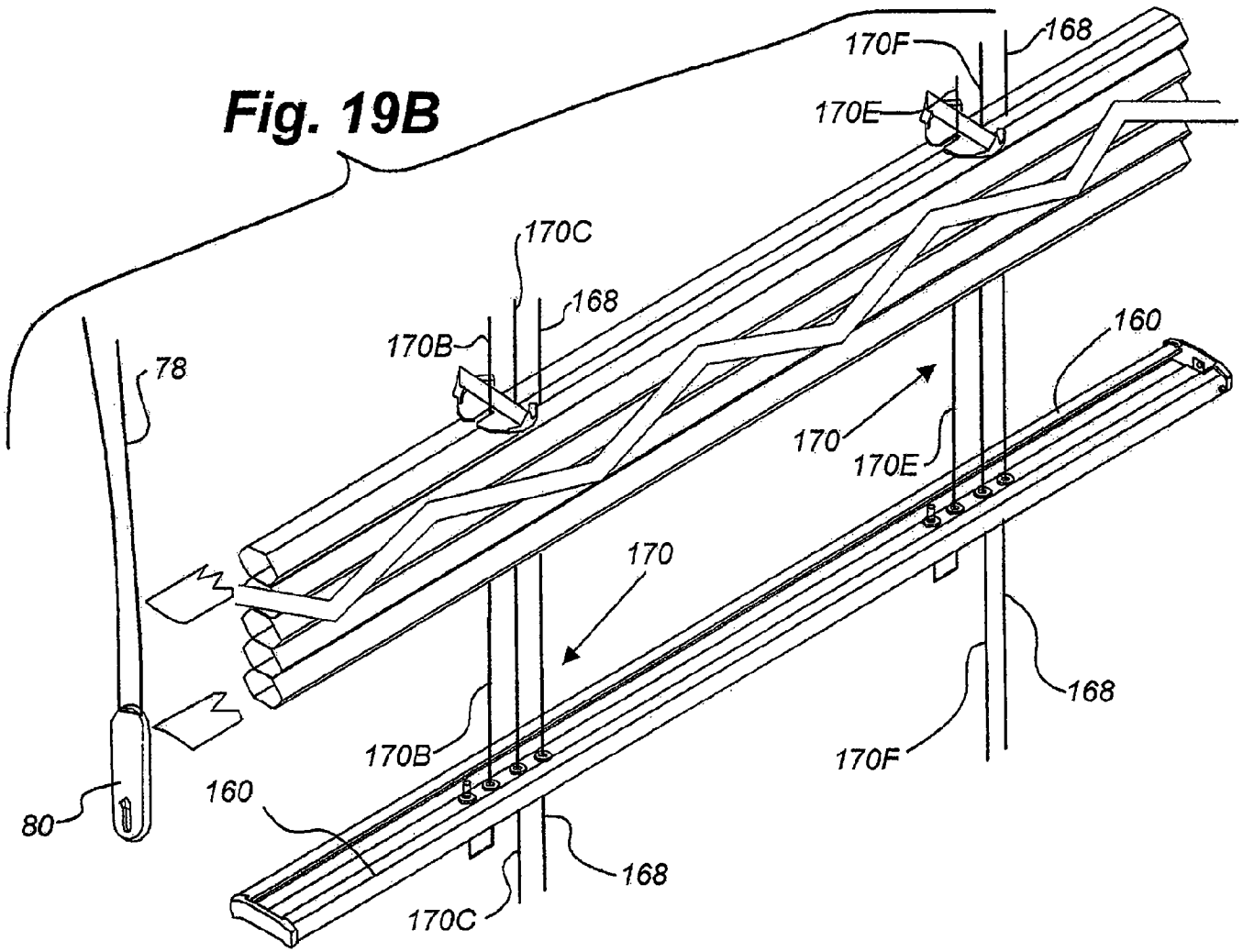
FIG. 19B is an exploded isometric with parts moved illustrating the upper shade panel and the middle rail of the covering of FIG. 17A.
Figure 19C:
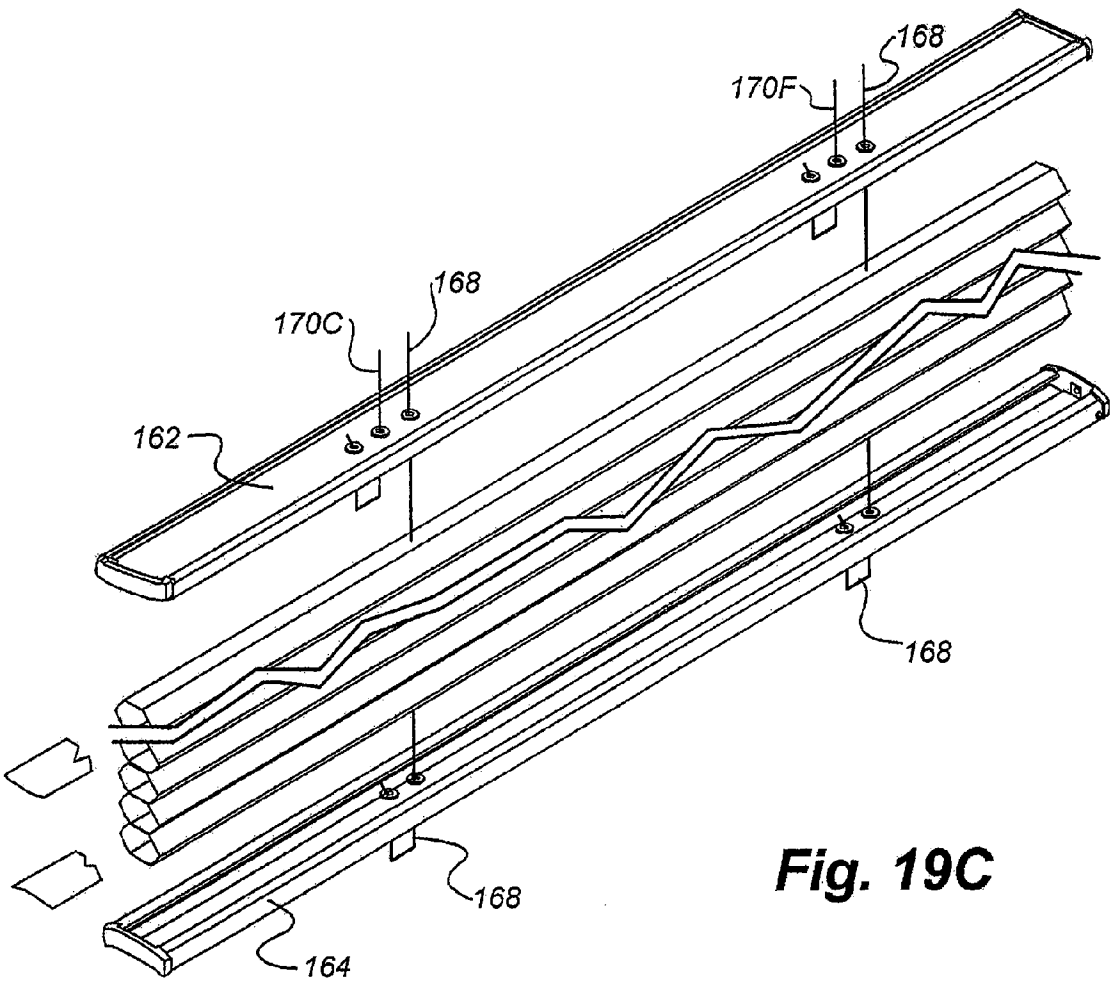
FIG. 19C is an exploded isometric showing the middle rail, lower shade panel, and the bottom rail of the covering of FIG. 17A.
Figure 20:
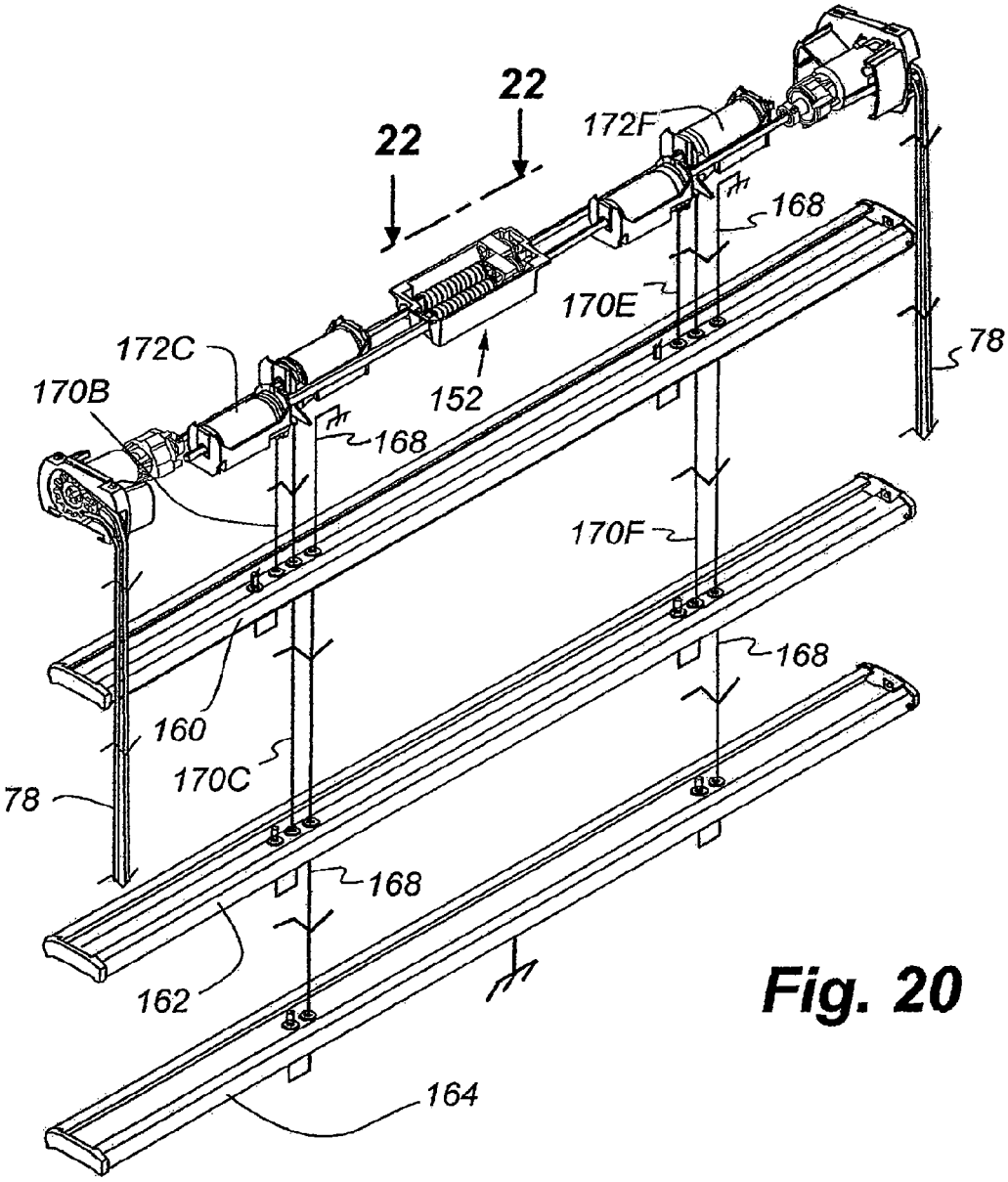
FIG. 20 is an isometric with parts removed showing the control system for the covering of FIG. 17A along with the top, middle, and bottom rails of the covering.

Looking next at FIGS. 19A-20, it will be appreciated, as mentioned above, that a headrail 46 with two identical but reversed control system components 154A and 154B are utilized for operating the covering. The only difference in the control system components of this arrangement and the arrangement of FIGS. 1-16D resides in a different cord tensioning system 152, which will be described hereafter, and the fact that static, fixed guide cords 168 (FIGS. 19A, 19B and 20) extend from an anchored location in the headrail 46 to the bottom rail 164 to guide movement of the top 160 and middle 162 rails in operation of the covering. In this arrangement of the covering, the control system component 154A shown in FIG. 19A to the left and above the other component 154B has lift cords 170C and 170F associated with its wrap spools 172C and 172F, respectively, with cords 170C and 170F extending downwardly and having their lower ends anchored to the middle rail 162 (FIG. 20) in a manner similar to that described in the first arrangement of the invention.

The lift cords 170B and 170E associated with the other or lower control system component 154B, as illustrated in FIG. 19A, extend downwardly and are anchored to the top rail, again in the same manner as described with the first arrangement of the invention. Accordingly, operation of the upper or left control system component 154A, as viewed in FIG. 19A, raises or lowers the middle rail 162 while operation of the lower or right component 154B, as viewed in FIG. 19A, raises or lowers the top rail 160. As can be appreciated, the top rail and the middle rail are each moved vertically independently of each other and, therefore, can be positioned at any desired location within the architectural opening within the operating parameters of the cord tensioning system 152. With this arrangement of a covering, however, the upper panel segment will always extend from the headrail to the top rail regardless of the positioning of the top rail, and the lower shade component will always extend from the bottom rail to the middle rail regardless of the positioning of the middle rail.

Referring next to FIGS. 22-29, the cord tension control system 152 will be described. The cord tension control system of this embodiment of the invention again includes two identical threaded shafts 174 and two identical abutment nuts 120, which are identical to those previously described and shown in FIGS. 13 and 14. The threaded shafts, as seen best in FIGS. 28 and 29, have a threaded elongated body portion 178, a small diameter end 180 and a large diameter end 182 with a longitudinally extending passage 184 therethrough of non-circular cross-section to correlate with that of the drive shaft for the control system component with which it is associated so that the threaded shaft rotates in unison with an associated drive shaft 68. The large diameter end of the threaded shaft has an outer ring 186 formed thereon of a first diameter that is spaced from a middle ring 188 of the same diameter to define a circumferential channel 190 therebetween. The middle ring in turn is spaced from a large diameter ring 192 forming still another circumferential channel 194 therebetween with the large diameter ring having a tapered radial catch or tooth 196 formed thereon facing the smaller end 180 of the threaded shaft. The first and middle rings each have an alignment tab 198 formed thereon which has no operative function other than to facilitate assembly of the threaded shaft on the drive shaft at a desired relationship between the drive shaft and the threaded shaft.

Figures 22, 23:
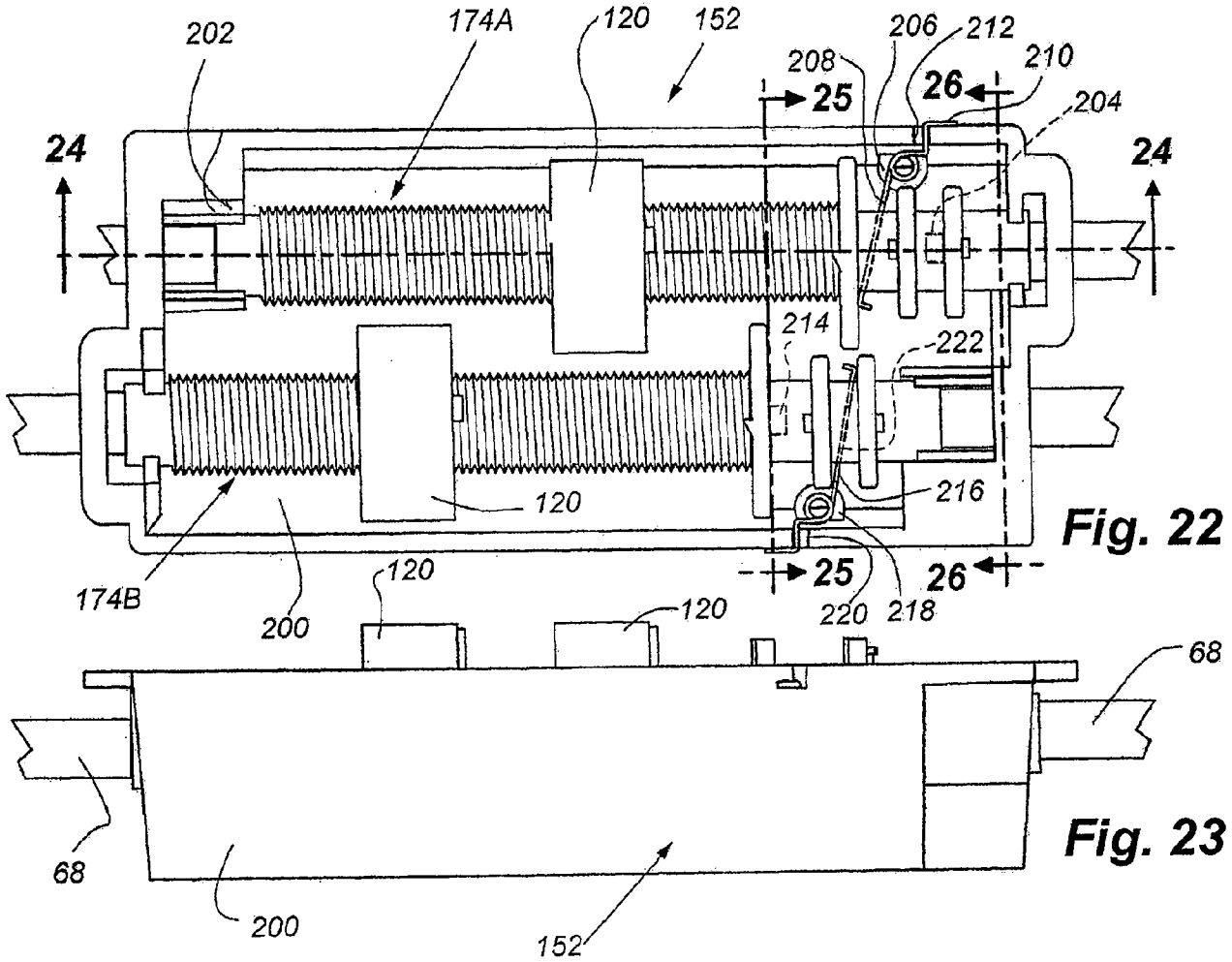
FIG. 22 is an enlarged fragmentary view taken along line 22-22 of FIG. 20.
FIG. 23 is a front elevation of the cord tension control unit shown in FIG. 22.
Figure 24:
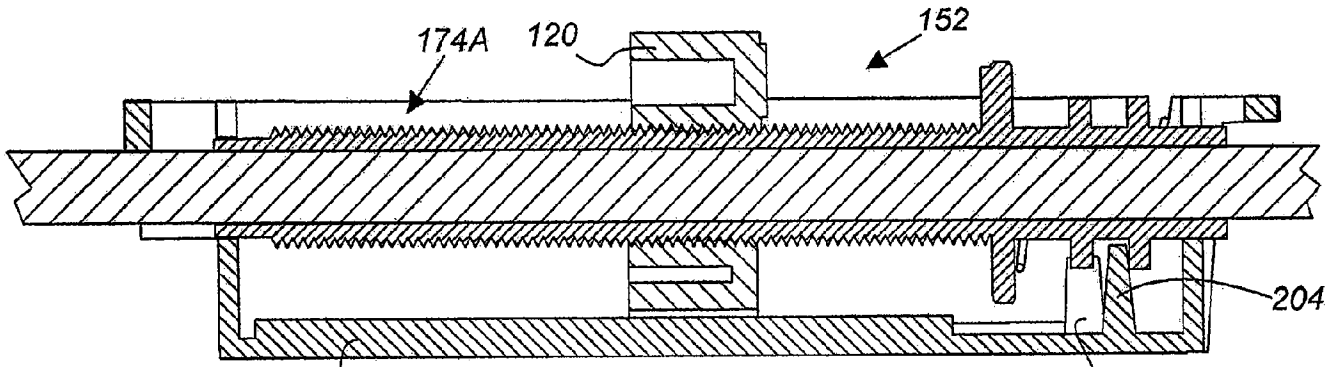
FIG. 24 is a section taken along line 24-24 of FIG. 22.
Figure 26:
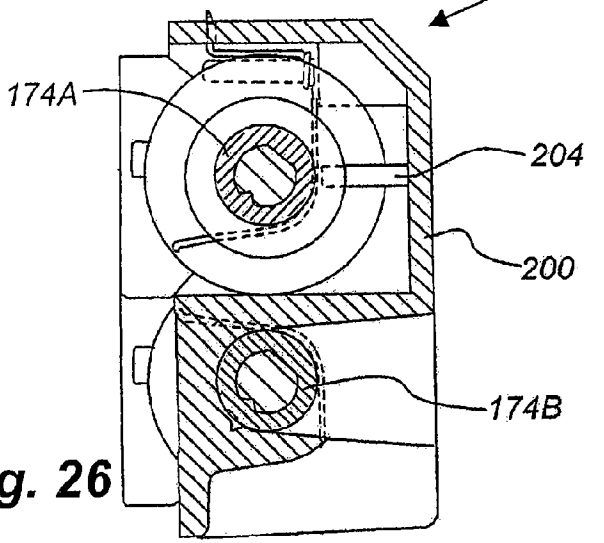
FIG. 26 is a section taken along line 26-26 of FIG. 22.
Figure 25:
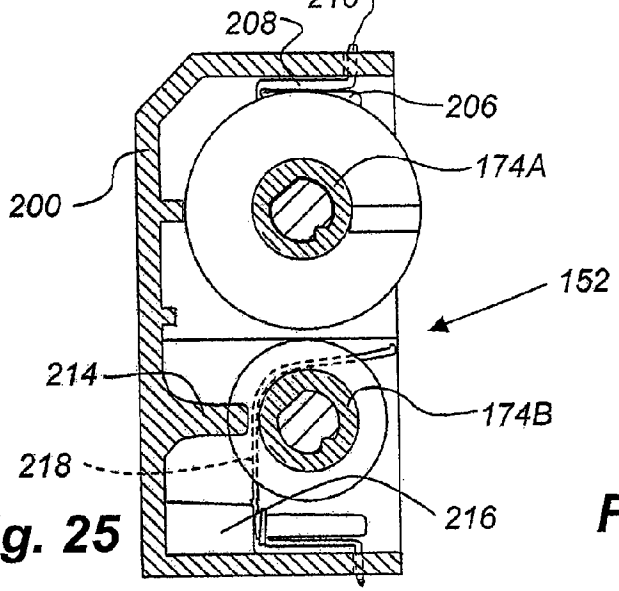
FIG. 25 is a section taken along line 25-25 of FIG. 22.
Figure 27:
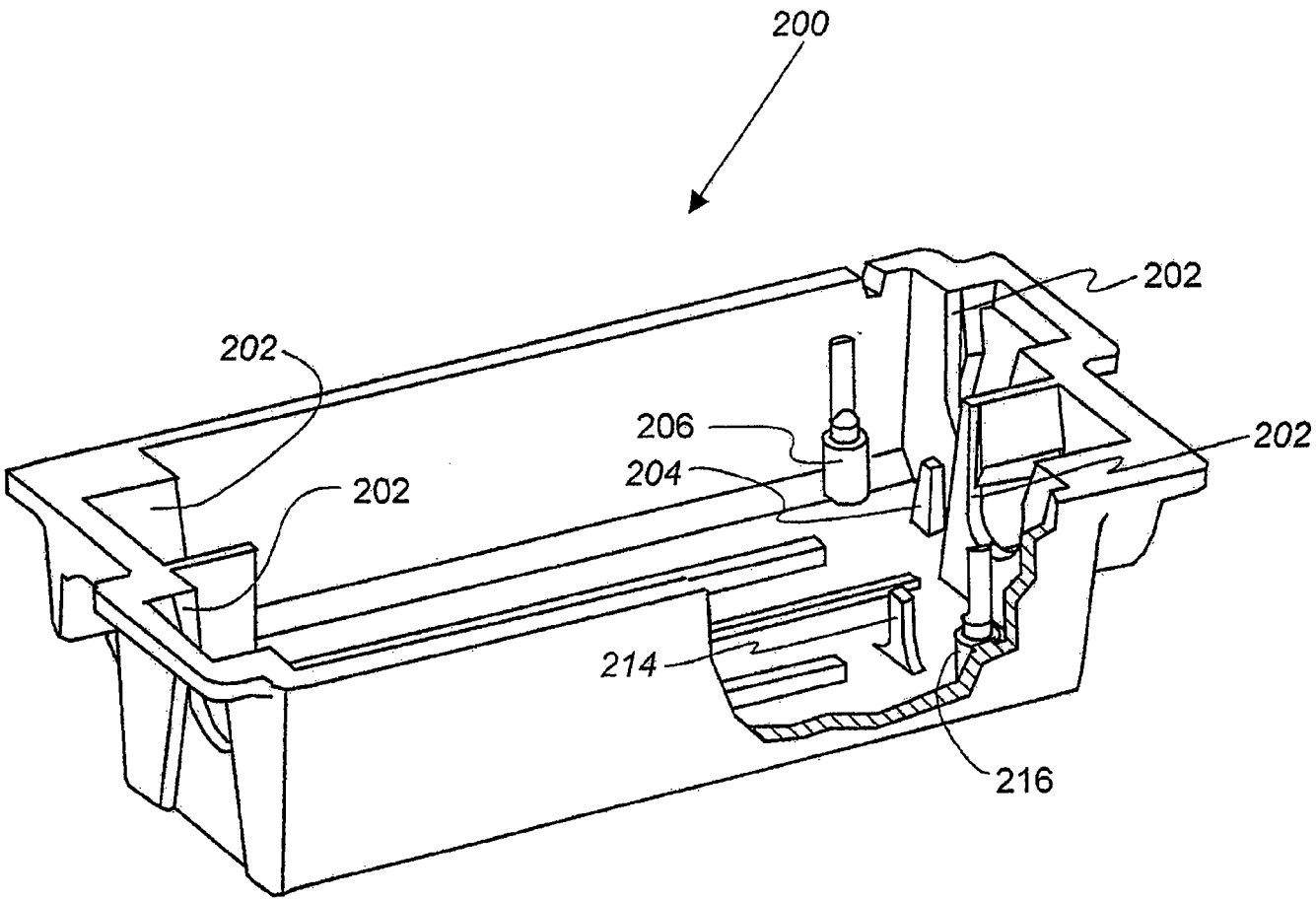
FIG. 27 is a top isometric with parts removed of the open topped housing for the cord tension control system shown in FIG. 22.
Figure 29:
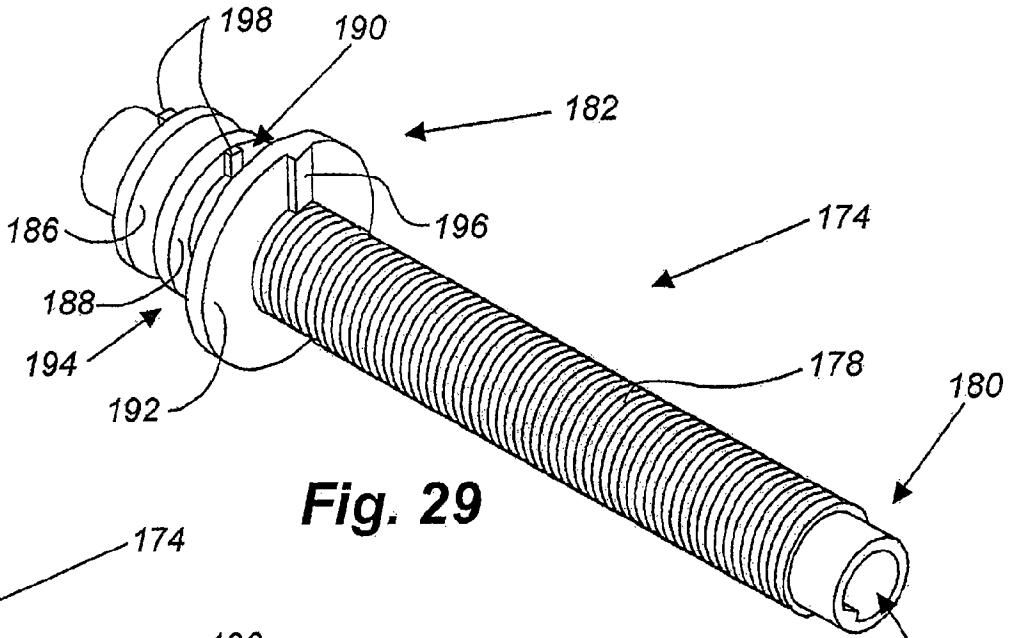
FIG. 29 is an isometric looking downwardly at the small end of the shaft shown in FIG. 28.
Figure 28:
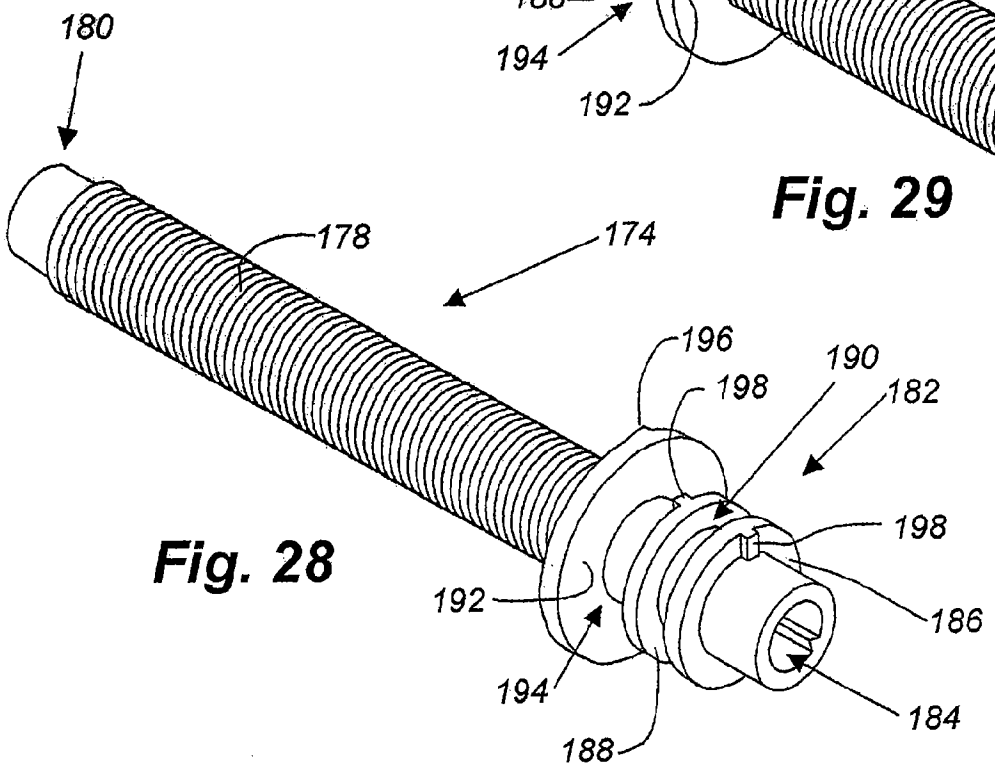
FIG. 28 is an isometric looking downwardly at the enlarged end of a threaded shaft used in the cord tension control system shown in FIG. 22.

The cord tension control system 152, as mentioned, further includes an abutment nut 120 on each threaded shaft with the abutment nuts, as mentioned previously, being identical to those described in connection with the first embodiment of the cord tension control system. The threaded shafts are rotatably supported within an open topped housing 200 shown best in FIG. 27 and shown in FIGS. 24-26 in operative relationship with threaded shafts 174A and 174B. As seen in FIG. 22, however, it will be appreciated the threaded shafts are offset longitudinally of each other similar to the first described embodiment and have the opposite ends of the threaded shafts rotatably received in cradles 202 that positively position the threaded shafts relative to the housing. The housing, of course, is fixedly positioned within the headrail 46 in any suitable manner.

Referring first to the upper threaded shaft 174A, as viewed in FIG. 22 as well as referencing FIGS. 24-27, it will be appreciated the housing 200 has an upstanding finger 204 formed on the bottom wall, which is adapted to extend into the gap between the outer 186 and middle 188 rings on the threaded shaft to prevent the upper threaded shaft from shifting to the left. A stanchion 206 is formed on the side wall of the housing immediately adjacent to the middle ring of the upper threaded shaft with the stanchion having a biasing spring 208 mounted thereon with one arm 210 of the spring extending through and being anchored in a hole 212 in the side wall of the housing and the opposite end of the spring engaging the surface of the large ring 192 which faces the middle ring. The spring 208 therefore biases the threaded shaft to the left, as viewed in FIG. 22, holding the outer ring against the abutment finger 204 to assure the desired positioning of the shaft relative to the housing and thus to the headrail itself.

Looking at the lower threaded shaft 1748, as viewed in FIG. 22 as well as to FIGS. 24-27, it will be seen that another abutment finger 214 is provided in the bottom wall of the housing and positioned in abutment with the face of the large ring 192 that faces the middle ring 188. This abutment finger prevents the lower threaded shaft from shifting to the right. The lower threaded shaft is biased to the right with a second spring 216 mounted on a second stanchion 218 on the opposite side wall of the housing with the spring being identical to the first spring having one finger extending through and being anchored in a hole 220 in the side wall and the opposite arm 222 of the spring engaging the face of the outer ring 186 that faces the middle ring so as to bias the lower threaded shaft to the right and into positive abutment with the abutment finger 214. The spring biasing system has been found desirable for positively positioning the threaded shafts relative to the housing so that there is no movement even during rotation of the threaded shafts and resulting translation of the abutment nuts mounted thereon.

Looking next at FIGS. 21A-21E showing five different positions of the covering and their correlated views of the cord tension control system 152 shown in FIGS. 30A-30E, respectively, it can be appreciated how the cord tension control system provides a positive system for controlling rotation of the drive shaft 68 and thus the wrap spools 172 to prevent entanglement of the lift cords 170 associated with the wrap spools.

Figure 21B:
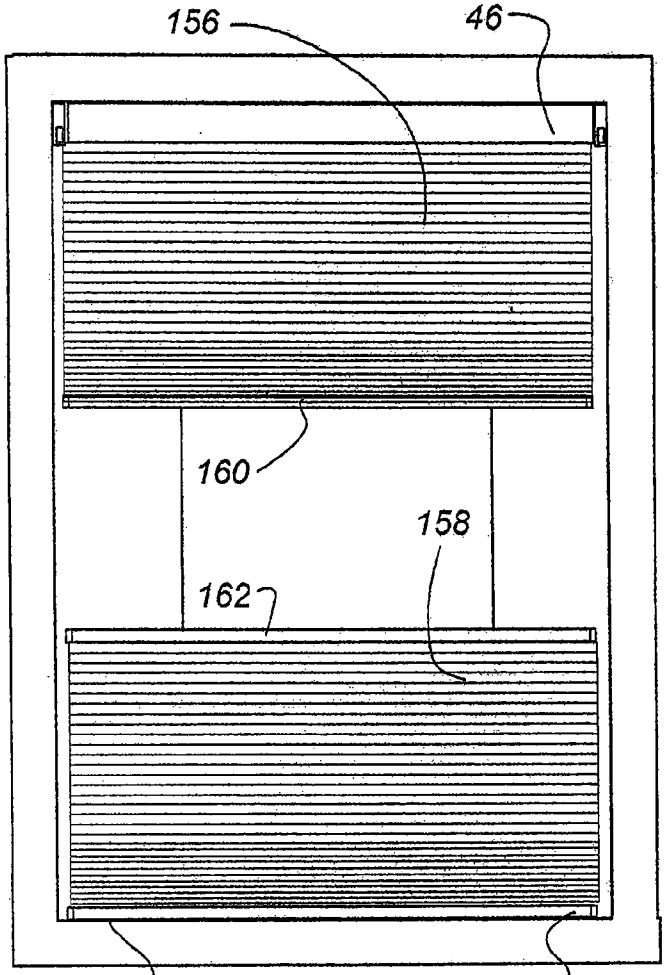
FIG. 21B is a front elevation similar to FIG. 21A showing the top rail having been partially raised, and the middle rail partially lowered.
Figure 21A:
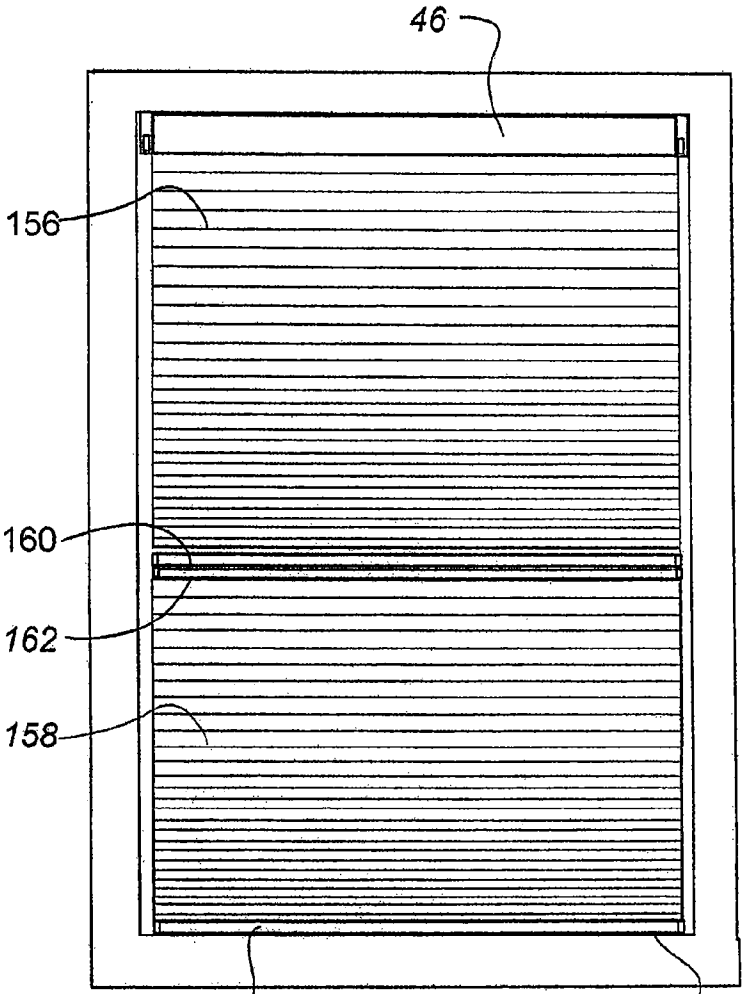
FIG. 21A is a front elevation showing the covering of FIG. 17A fully extended and in an architectural opening.
Figure 30A:
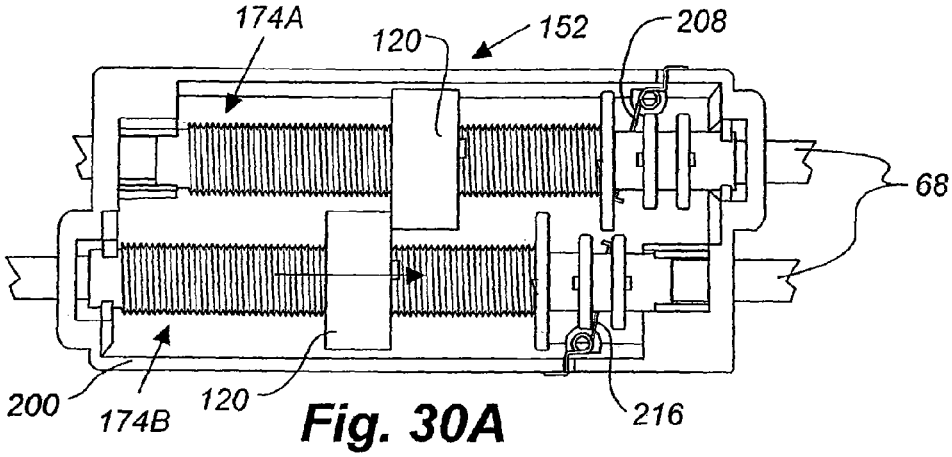
FIG. 30A is a top plan view of the cord tension control system shown in FIG. 22 with the abutment nuts positioned where they would be when the covering was in the position of FIG. 21A.
Figure 30B:
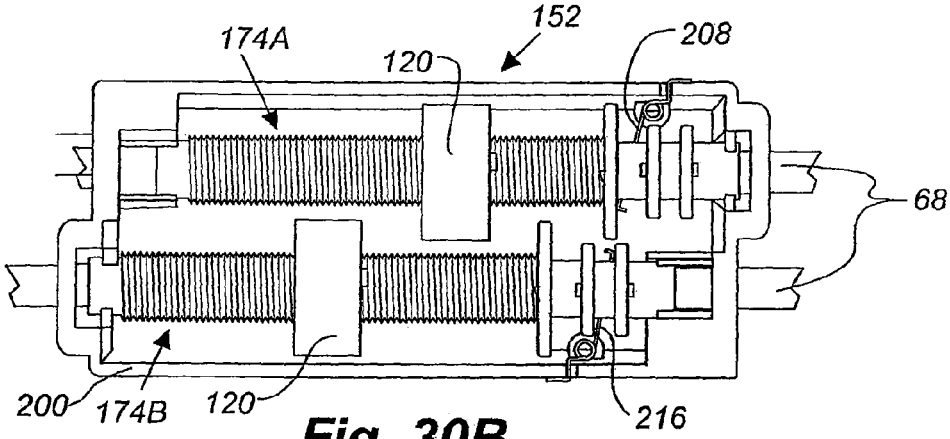
FIG. 30B is a top plan view of the cord tension control system of FIG. 22 with the abutment nuts positioned where they would be with the covering in the position of FIG. 21B.
Figure 30C:
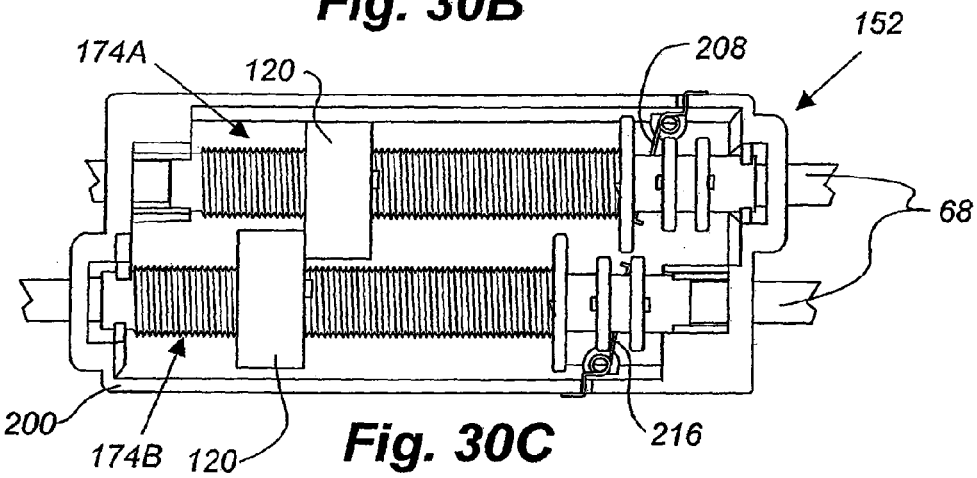
FIG. 30C is a top plan view of the cord tension control system shown in FIG. 22 with the abutment nuts in the position in which they would be with the covering in the position of FIG. 21C.
Figure 30D:
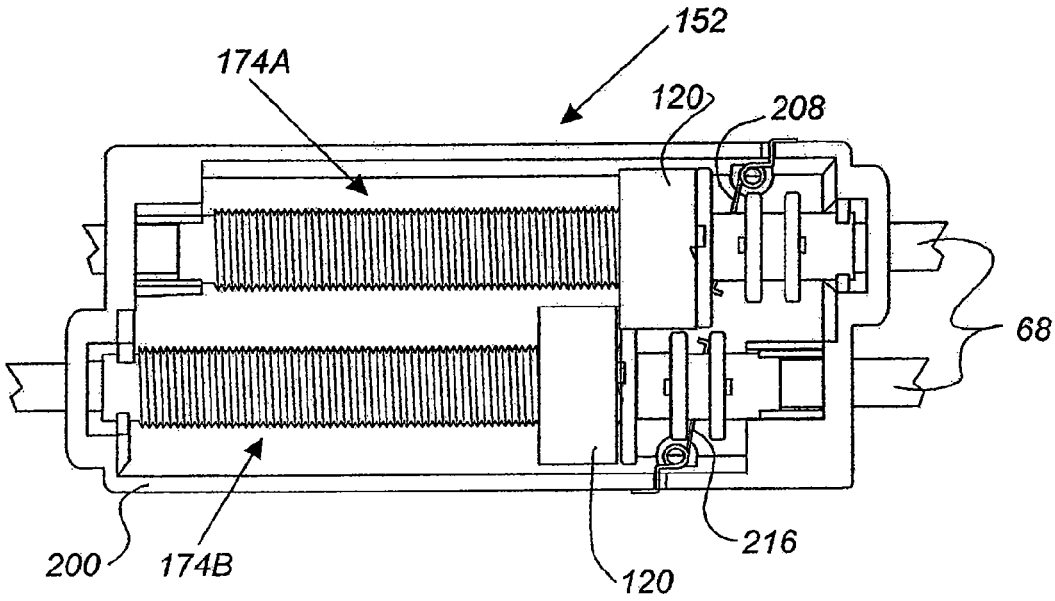
FIG. 30D is a top plan view of the cord tension control system of FIG. 22 with the abutment nuts in the position they would assume with the covering in the position of FIG. 21D.

Looking first at FIG. 21A, it will be seen the top rail 160 is positioned approximate to the middle of the architectural opening 42 with the middle rail 162 positioned contiguous therewith also at the approximate center of the architectural opening. As seen in FIG. 30A, the abutment nut 176 on the upper shaft 174A is at the approximate longitudinal center of the associated threaded shaft and in abutment with the abutment nut on the lower threaded shaft 174B, which is also at the approximate longitudinal center of its threaded shaft. It is when the rails 160 and 162 are in abutment, as shown in FIG. 21A, that it is desired that the abutment nuts also be abutted to prevent an operator from trying to move either the upper or middle rail toward the opposite of the upper or middle rail more than is desired which may cause entanglement of the lift cords associated with the wrap spools. Accordingly, the abutment of the nuts, as seen in FIG. 30A, positively prevents the rails from moving beyond their abutment, as shown in FIG. 21A.

In FIG. 21B, the upper rail 160 has been raised a short distance while the middle rail 162 has been lowered a shortened distance which causes the upper abutment nut 176 to shift to the right, and the lower abutment nut to shift to the left into separate positions.

Figure 21D:
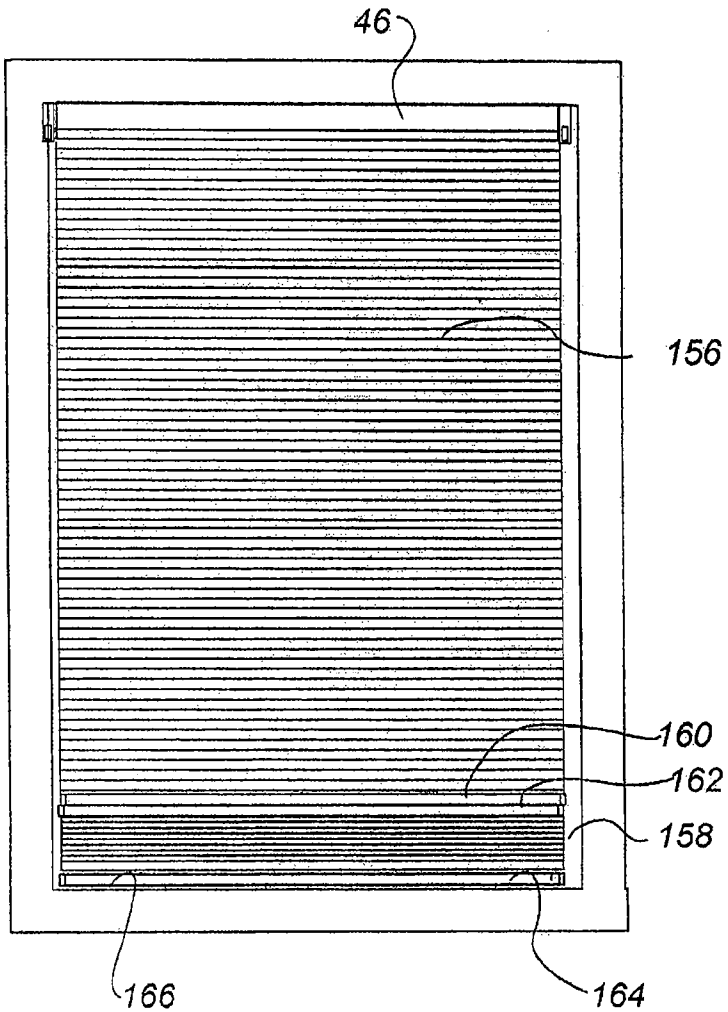
FIG. 21D is a front elevation of the covering of FIG. 17A showing the middle rail having been fully lowered, and the top rail having been lowered into contiguous relationship with the middle rail.
Figure 21C:
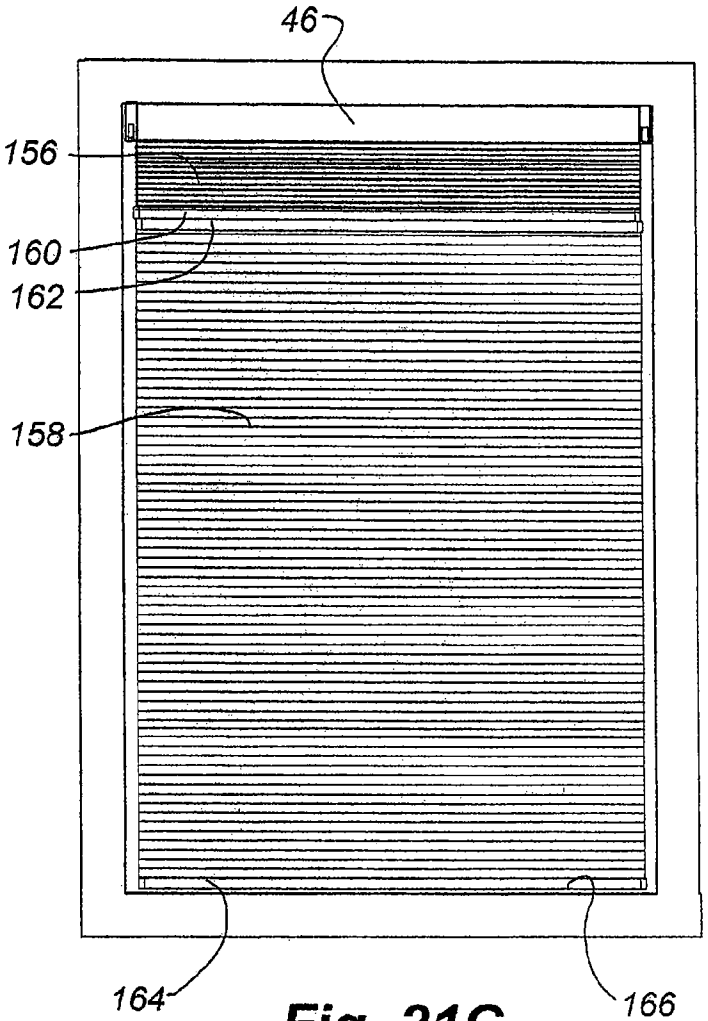
FIG. 21C is a front elevation of the covering of FIG. 17A showing the top rail having been fully raised, and the middle rail raised into contiguous relationship with the top rail.

Referring to FIG. 21C, the top rail 160 has been raised near the headrail 46 of the covering so that its associated nut 176 (the lower abutment nut shown in FIG. 30C) is closer to the left end of the threaded shaft 174B, and the middle rail 162 has been raised into abutment with the top rail so that again the abutment nuts are engaged as no further movement of the rails toward each other is desirable as it might cause entanglement of the lift cords. Of course the abutment of the abutment nuts positively prevents any further movement and thus prevents entanglement.

Looking at FIG. 21D, the middle rail 162 has been lowered fairly closely to the bottom rail 164, and the top rail 160 has been lowered into abutting contiguous relationship with the middle rail. Again, while the nuts 176 on their associated shafts have been shifted to the right, since both the top rail and the middle rail have been lowered, they are abutting as are the top and middle rails to positively prevent any further movement of the rails toward each other. As mentioned above, this prevents the possibility of entanglement of the lift cords.

Figure 21E:
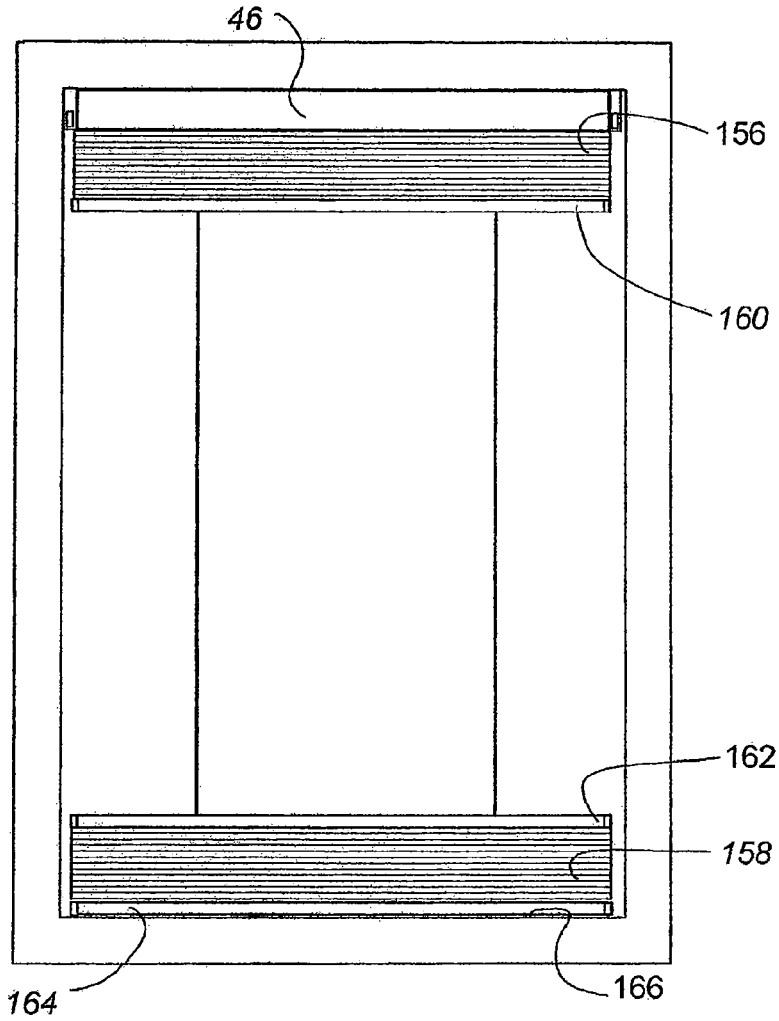
FIG. 21E is a front elevation of the covering of FIG. 17A showing the top rail having been fully raised, and the middle rail fully lowered.
Figure 30E:
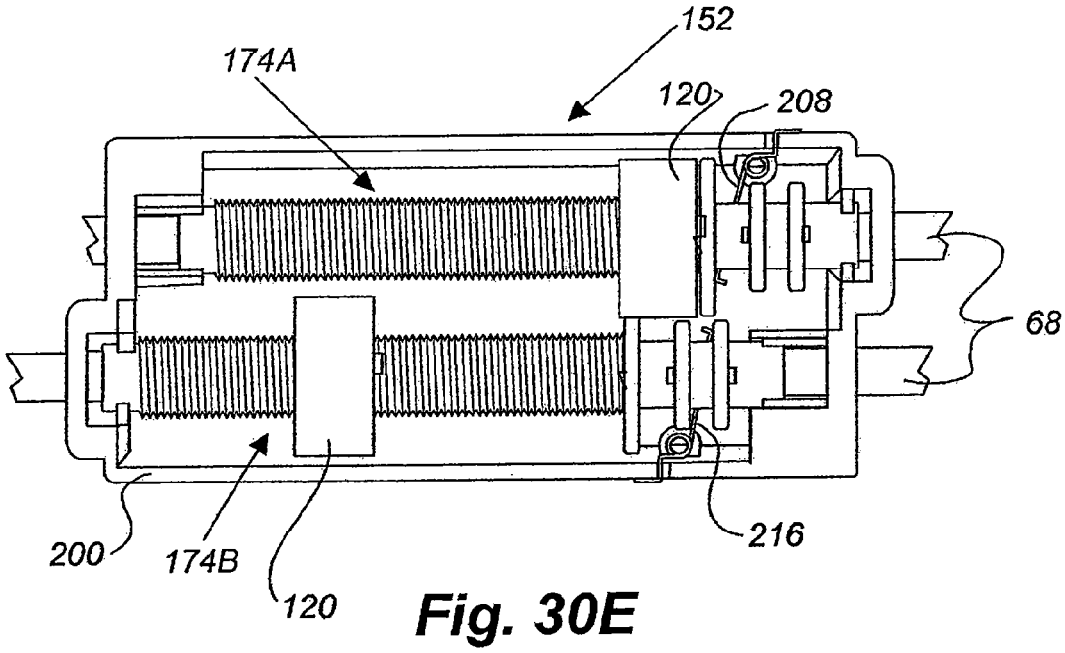
FIG. 30E is a top plan view of the cord tension control system shown in FIG. 22 with the abutment nuts in the position they would assume with the covering in the position of FIG. 21E.

Referring to FIG. 21E, the top rail 160 has been raised adjacent to the headrail 46, and the middle rail 162 has been lowered adjacent to the bottom rail 164 so that the nuts 176 associated with the rails, as seen in FIG. 30E, are separated as dictated by the positioning of the top and middle rails.

Accordingly, it will be appreciated with this embodiment of the cord tension control system 152 that the possibility of entanglement of the lift cords associated with the wrap spools on the drive shafts 68 is diminished by preventing the top and middle rails from being moved further toward each other than is desirable as such compressive movement of one rail toward the other has been known to cause entanglement of the lift cords particularly when one moving rail moves a second movable rail out of position creating slack in the lift cords associated with the second movable rail. Further in this embodiment, the threaded shafts are positively positioned so as not to be effected by their rotation or the abutment of the abutment nuts by the spring biasing systems which hold the threaded shaft against a fixed finger formed in the housing.

A third embodiment of a cord tension control system pursuant to the present invention is shown in FIGS. 31-40 with this embodiment of the cord tension control system being applicable for use in connection with either one of the top down/bottom up covering arrangements previously described. In other words, the third embodiment of the cord tension control system would work with an arrangement where there was a single collapsible panel between a movable top and bottom rail or in an arrangement where there were two collapsible panels with an upper collapsible panel extending from a fixed headrail to a movable top rail, and a bottom panel extending from a movable middle rail to a fixed bottom rail. As in the first two described embodiments of the cord tension control system, the third embodiment includes an open-topped housing 240 to be described in detail hereafter with two identical threaded shafts 242 being rotatably positioned therein and keyed to associated drive shafts 244 for one of the movable rails in the covering and with each threaded shaft having a threaded abutment or adjustment nut 246 thereon which overlaps the nut of the adjacent threaded shaft so that the nuts abut each other when no further movement of one of the movable rails in the covering is desired.

Figures 32, 33:
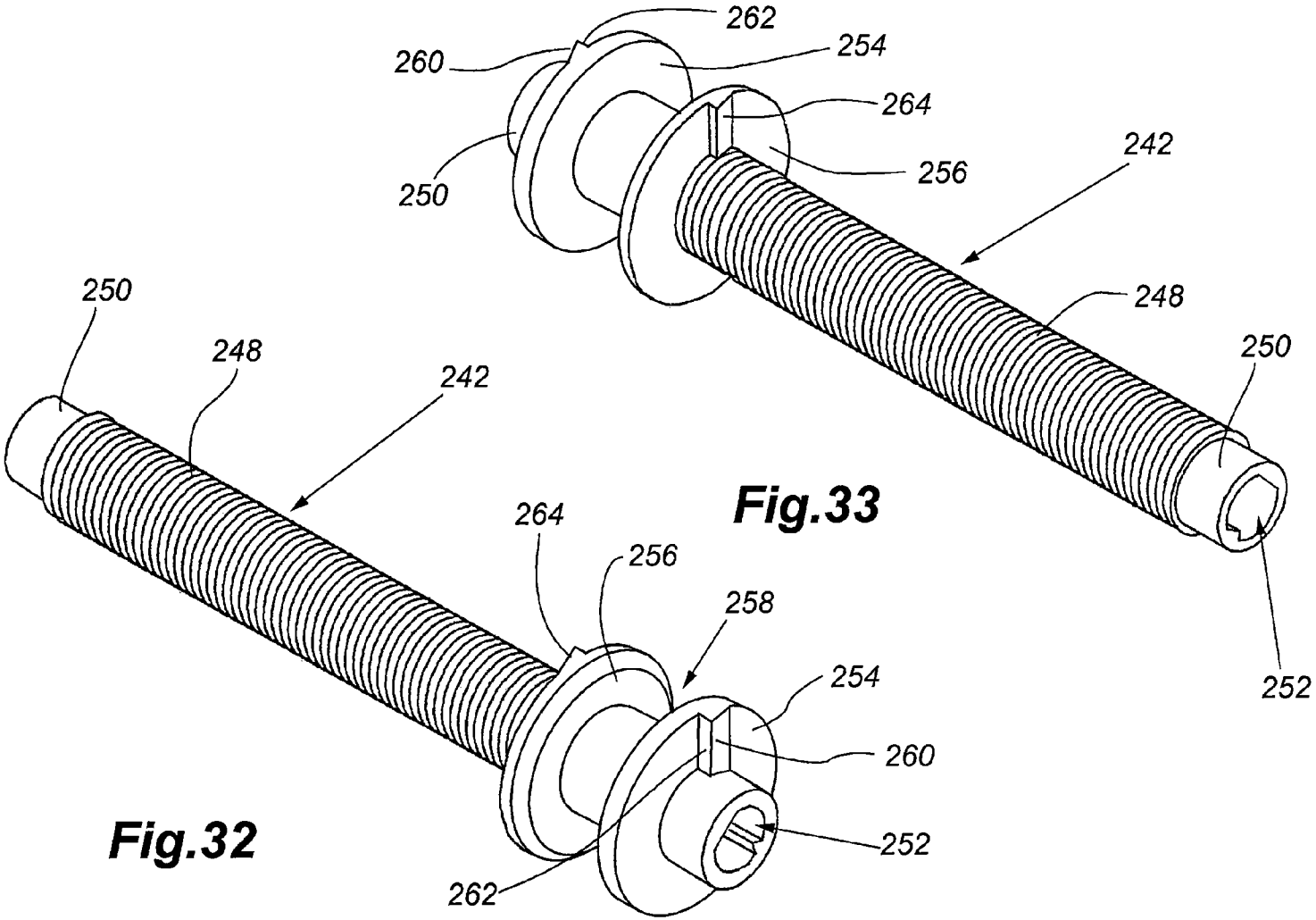
FIG. 32 is an isometric looking downwardly at the enlarged end of a threaded shaft used in the cord tension control system of the third embodiment.
FIG. 33 is an isometric similar to FIG. 32 looking downwardly at the opposite end of the threaded shaft.

Referring first to FIGS. 32 and 33, the threaded shaft 242 used in the third embodiment is illustrated and can be seen to have a threaded segment 248 along a hollow shaft 250 with the hollow shaft having a passageway 252 therethrough of noncircular cross-section to correlate with that of the drive shaft 244 so that the threaded shaft rotates in unison with the drive shaft as in the first two described embodiments. At a large end of the threaded shaft, an outer ring 254 and an inner ring 256 are provided of equal diameter and which are spaced so as to define a circumferential groove 258 therebetween. The outer ring has a radial tooth 260 extending away from the inner ring on its outer face with the tooth defining a flat engagement surface 262 extending in an axial direction while the inner ring has an identical abutment tooth 264 on its inwardly directed face which faces away from the outer ring. The threaded shafts are adapted to be seated in the open-topped housing 240 of FIG. 31 as seen probably best in FIGS. 34, 36 and 37 so that they extend in opposite directions, that is with the large end of one shaft (the upper shaft as viewed in FIGS. 34, 36 and 37) being at the right end of the housing and the large end of the lower threaded shaft as viewed in FIGS. 34, 36 and 37 being at the left end of the housing. The housing has appropriate cradles 266 and 268 at opposite ends to rotatably support the associated ends of the threaded shafts so that the threaded shafts can rotate within the cradle and as they rotate the associated abutment nuts 246 are translated along the length of the threaded shafts as in the prior described embodiments. Rails 270 on the bottom wall 272 of the housing prevent the nuts from rotating relative to the housing but permit the nuts to translate along the lengths of the threaded shafts as the associated threaded shafts are rotated by the associated drive shafts.

Figure 31:
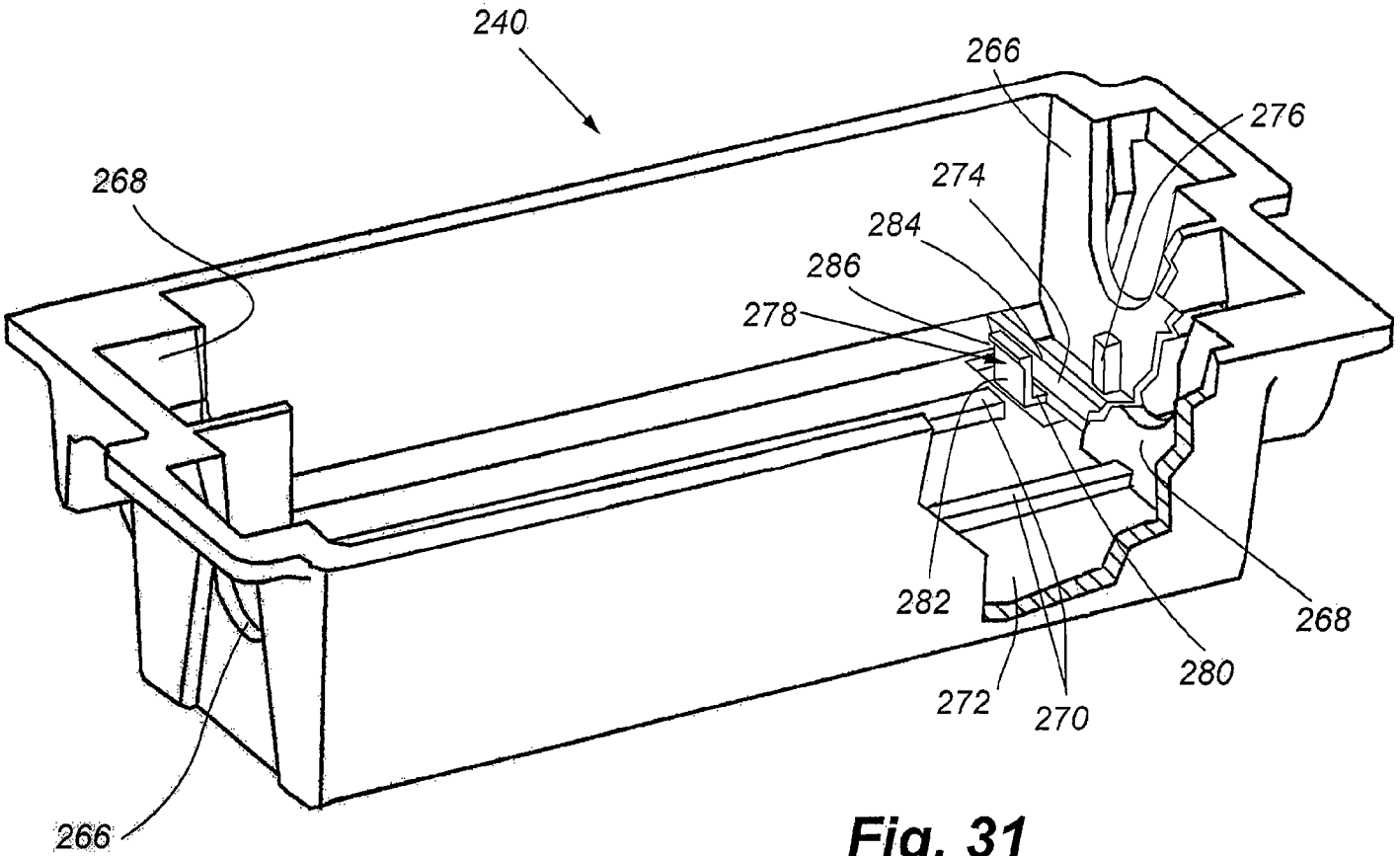
FIG. 31 is an isometric with parts removed of a open topped housing for a third embodiment of the cord tension control system of the invention.

As best appreciated by reference to FIG. 31, the end of the housing 240 having the cradle 266 supporting the large end of a threaded shaft 242 has a transversely extending rib 274 of rectangular cross-section projecting upwardly from the bottom wall 272 of the housing and spaced outwardly or toward the adjacent end of the housing a vertically extending abutment tab 276 is positioned to abut the radial tooth 260 on the outer ring 254 as will be described hereafter. Inwardly of the transverse rib 274 is a generally Z-shaped spring arm 278 which could be metal or plastic having a lower horizontal leg 280 anchored to the housing as seen, for example, in FIGS. 38 and 39, an intermediate leg 282 extending vertically in a neutral position and an upper leg 284 extending toward the opposite end of the housing from that of the lower leg. The free edge 286 of the upper leg is positioned to engage the inner ring 256 of the associated threaded shaft and yieldingly resists movement of the shaft in a direction toward the end of the housing supporting the large end of the threaded shaft.

Figure 34:
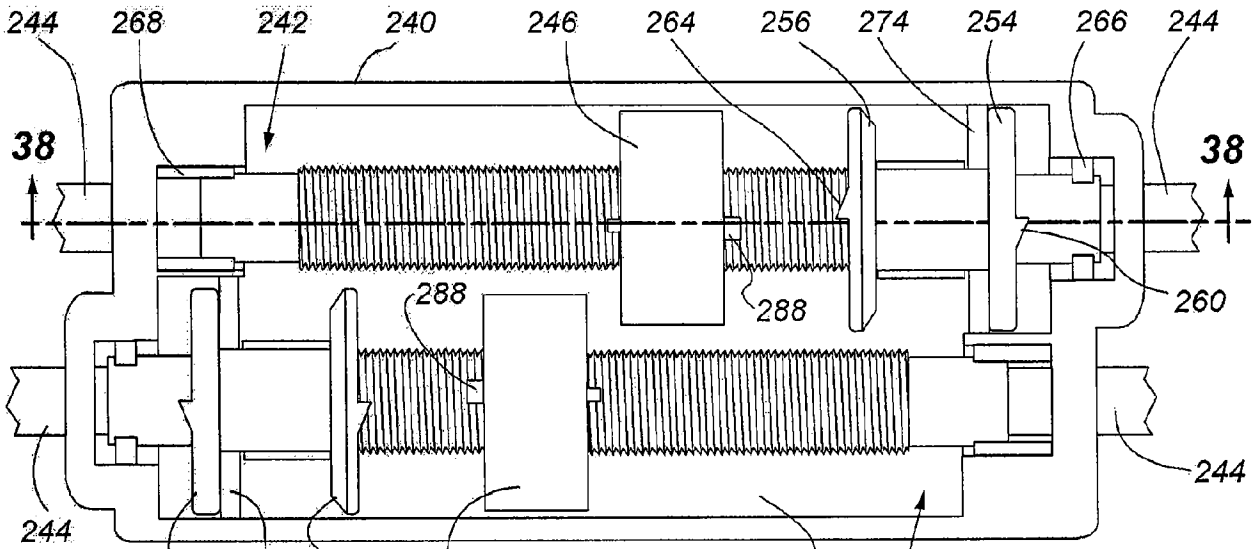
FIG. 34 is a top plan view looking downwardly into the open-topped housing with a pair of the threaded shafts seated therein.
Figure 35:
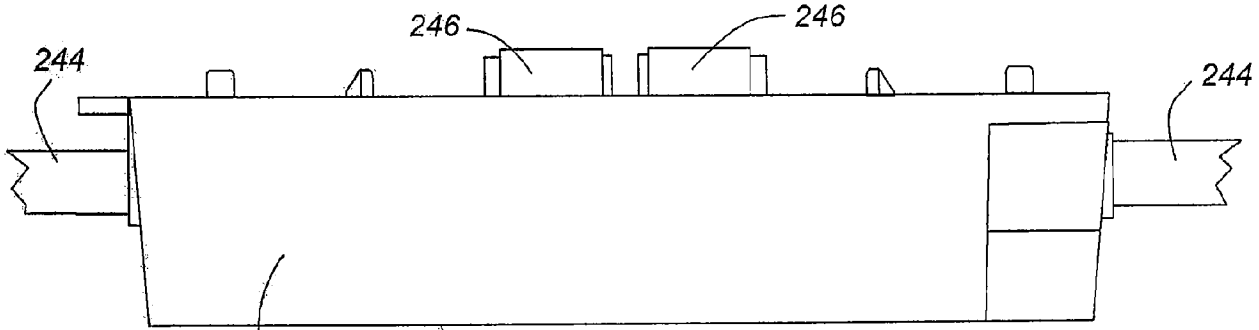
FIG. 35 is a front elevation of the control system as shown in FIG. 34.
Figure 36:
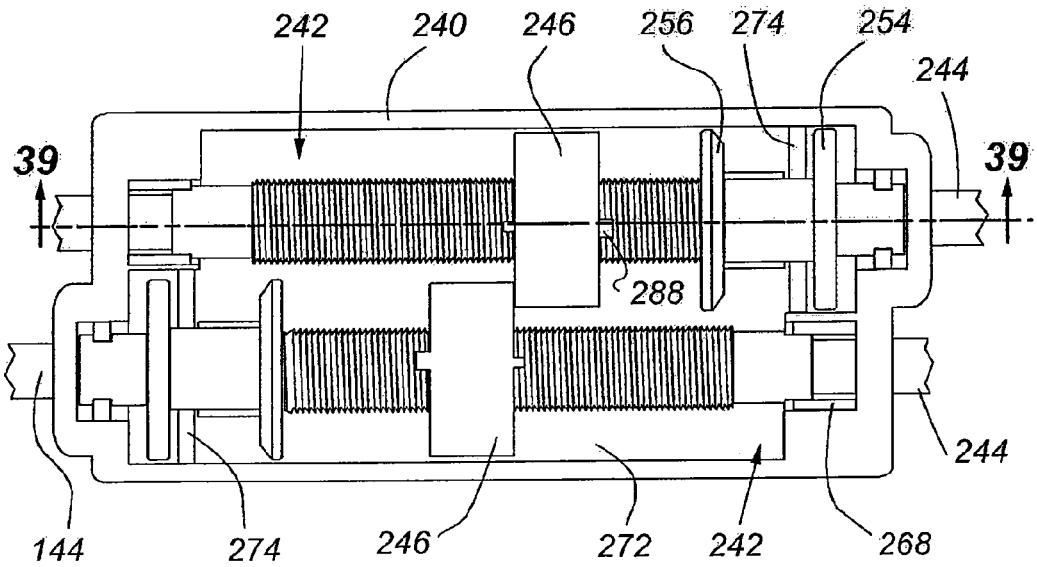
FIG. 36 is a top plan view similar to FIG. 34 showing the abutment nuts in abutting relationship.
Figure 37:
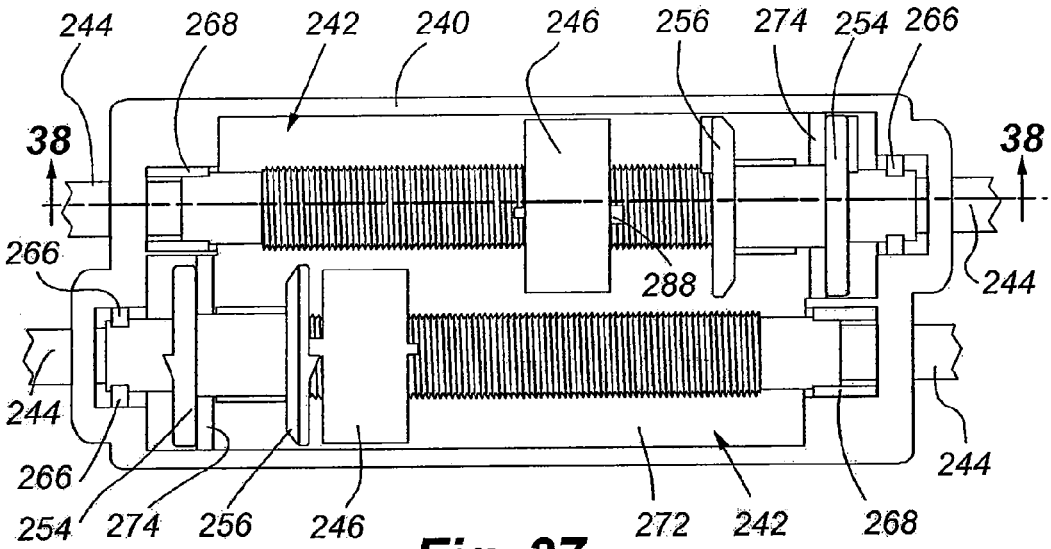
FIG. 37 is a top plan view similar to FIG. 36 showing the abutment nuts separated from each other.

Referring to FIG. 36, the abutment nuts 246 are shown abutting each other which would be the case when the movable rails associated with each threaded shaft 242 are closely positioned relative to each other and at a position where it is not desired that they move any further toward each other. FIG. 34 shows the abutment nuts separated as when the associated movable rails are separated from each other, and FIG. 37 shows the abutment nuts even further separated and with the abutment nut of the bottom threaded shaft as viewed in FIG. 37, which is associated with the uppermost one of the two movable rails, in abutment with the inner ring 256 of its associated threaded shaft and with a radial rib 288 on the abutment nut engaged with the radial tooth 264 of the inner ring to prevent any further rotation of the threaded shaft in a direction which would cause its abutment nut to move toward the inner ring.

Figure 38:
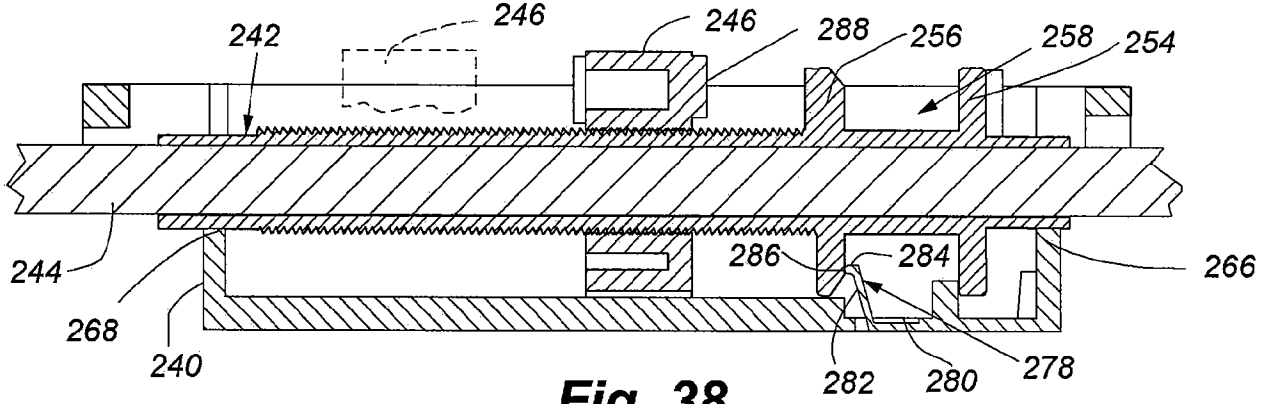
FIG. 38 is a fragmentary vertical section taken along line 38-38 of FIG. 37 showing the abutment nut of the lower shaft as viewed in FIG. 37 in dashed lines.
Figure 39:
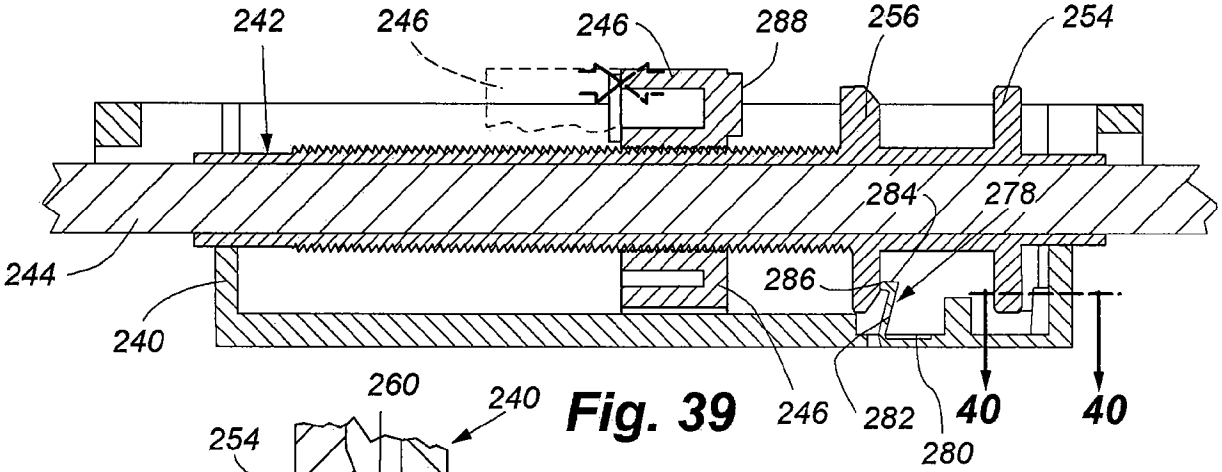
FIG. 39 is a fragmentary vertical section taken along line 39-39 of FIG. 36 showing the abutment nut of the bottom shaft as viewed in FIG. 36 in dashed lines.
Figure 40:
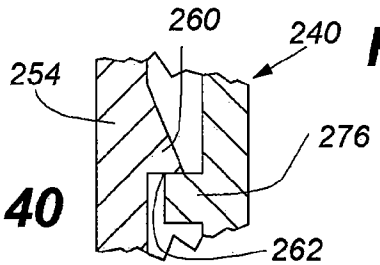
FIG. 40 is an enlarged fragmentary section taken along line 40-40 of FIG. 39.

Referring to FIGS. 38 and 39, the operation of the spring arm 278 and the transverse rib 274 and abutment tab 276 are illustrated. In other words, FIGS. 38 and 39 are sections through the upper threaded shaft 242 as viewed in FIGS. 34, 36 and 37, which threaded shaft is associated with the lowermost one of the two movable rails in the covering. If the control cord for the lower movable rail is being rotated in a direction causing the abutment nut 246 on the upper threaded shaft to translate to the left as viewed in FIGS. 38 and 39, or if the lower threaded shaft associated with the uppermost movable rail in the covering is rotated so that its abutment nut is translated to the right, as shown in FIG. 39, the nuts will ultimately become engaged as illustrated in FIG. 39. When this happens, as shown in FIG. 39, the abutment nuts will react by initially pushing their associated threaded shafts in opposite directions toward their large ends against the bias of the associated spring arms 278 which allow the threaded shafts to shift a small amount in a direction toward their large end until the outer ring on the threaded shaft engages or substantially engages an associated abutment tab 276 in the housing, which is then aligned with the radial engagement tooth 260 on the outer ring, as seen in FIG. 39. This, of course, positions the threaded shafts so they cannot be rotated in a direction which would cause their associated abutment nuts to translate toward each other thus terminating movement of their associated rails in the covering.

It will therefore be appreciated that the cord tension control system of the third embodiment allows an initial yielding movement of the movable rails toward each other, but once the initial yielding movement has occurred, there will be a very positive blockage of movement of one rail toward the other due to the interrelationship of the radial teeth 260 on the associated abutment tabs 276 within the cord tension control system.

Pursuant to the above, it will be appreciated that a top down/bottom up covering has been shown in two different arrangements and with three different embodiments of a cord tension control system that resists lift cords from entangling on their wrap spools. The entanglement is prevented by correlating abutment nuts on threaded shafts with the wrap spools and the associated lift cords to prevent over-movement of rails toward each other, which over-movement has been found to increase the likelihood of entanglement of the lift cords.

Although the present invention has been described with a certain degree of particularity, it is understood the disclosure has been made by way of example, and changes in detail or structure may be made without departing from the spirit of the invention as defined in the appended claims.

What is claimed is:

1. A top down/bottom up covering for an architectural opening comprising in combination:

a headrail;

at least two horizontally disposed vertically movable rails supporting at least one panel of collapsible shade material;

at least two flexible lift cords affixed to each rail;

a control system component associated with each rail, each component including an elongated drive shaft, a system for reciprocally and reversibly rotating said drive shaft about its longitudinal axis, a wrap spool rotatable with said drive shaft and connected to a lift cord such that said lift cord can be wrapped about or unwrapped from said wrap spool, vertical movement of said rails being effected by wrapping and unwrapping of said lift cords about said spools, and a cord tension control system for preventing said lift cords from becoming entangled at said wrap spools, said cord tension control system including a threaded shaft associated with and rotatable in unison with each drive shaft, a nut threaded on each of said threaded shafts for translating movement along an associated shaft, the nuts on said threaded shafts overlapping in their path of travel along an associated threaded shaft whereby upon engagement of said nuts with an adjacent nut the drive shafts will be prohibited from rotating in a predetermined direction thereby prohibiting the wrap spools on said drive shafts from rotating;

said cord tension control system further including a housing in which said threaded shafts are rotatably mounted, fixed abutments in said housing in engagement with said threaded shafts to prevent a predetermined amount of axial movement of said shafts in a predetermined direction and resilient members in said housing biasing each of said shafts against said fixed abutments.

2. The covering of claim 1 wherein said resilient members are springs fixedly mounted relative to said housing and engaging an associated threaded shaft.

3. The covering of claim 2 wherein said threaded shafts include protrusions for engagement with said fixed abutments.

4. The covering of claim 3 wherein said protrusions are axially spaced radially extending rings.

5. The covering of claim 1 wherein said housing has side walls and a bottom wall, said springs being mounted on said side walls.

6. The covering of claim 1 wherein said housing has side walls and a bottom wall, said springs being mounted on said bottom wall.

7. The covering of claim 1 wherein said housing has side walls and a bottom wall and said fixed abutments are on said bottom wall.

8. The covering of claim 4 wherein there are at least two of said rings.

9. The covering of claim 8 wherein there are three of said rings.

10. The covering of claim 1 wherein at least one of said fixed abutments is positioned between two of said rings.

11. The covering of claim 4 wherein at least one of said rings includes a radial tooth for engagement with a fixed abutment to prevent rotation of the threaded shaft.

12. The covering of claim 4 wherein at least one of said rings includes a radial tooth for engagement with the nut on the associated threaded shaft.

13. A covering for an architectural opening comprising:

a headrail;

at least two rails supporting at least one panel of shade material;

at least two flexible lift cords affixed to each rail;

a control system component associated with each rail, each component including a drive shaft, a system for rotating said drive shaft about its longitudinal axis, a wrap spool rotatable with said drive shaft and associated with a lift cord so that said lift cord can be wrapped about or unwrapped from said wrap spool, vertical movement of said rails being effected by wrapping and unwrapping of said lift cords about said wrap spools, and a cord tension control system including a threaded shaft rotatable in unison with each drive shaft, a nut threaded on each of said threaded shafts for movement along an associated threaded shaft, said nuts on said threaded shafts overlapping in their path of travel along an associated threaded shaft so that rotation of said drive shafts is restricted upon engagement of one of said nuts with another of said nuts, thereby restricting rotation of said wrap spools on said drive shafts;

said cord tension control system further including a housing in which said threaded shafts are rotatably mounted, fixed abutments in said housing in engagement with said threaded shafts to restrict axial movement of said shafts, and resilient members in said housing biasing each of said shafts against said fixed abutments.

14. The covering of claim 13 wherein said resilient members are springs fixedly mounted relative to said housing and engaging an associated threaded shaft.

15. The covering of claim 14 wherein said threaded shafts include protrusions for engagement with said fixed abutments.

16. The covering of claim 15 wherein said protrusions comprise at least two axially-spaced, radially-extending rings.

17. The covering of claim 16 wherein at least one of said fixed abutments is positioned between two of said rings.

18. The covering of claim 13 wherein said housing has side walls and a bottom wall, said springs being mounted on said side walls.

19. The covering of claim 13 wherein said housing has side walls and a bottom wall, said springs being mounted on said bottom wall.

20. The covering of claim 13 wherein said housing has side walls and a bottom wall, and said fixed abutments are on said bottom wall.

* * * * *